US005224496A

United States Patent [19]

Palmer et al.

[11] Patent Number: 5,224,496

[45] Date of Patent: Jul. 6, 1993

[54] PHYSICAL RESTRAINT MONITORING SYSTEM

[75] Inventors: Morris J. Palmer; Brent L. Johnson; Bradley L. Garrison, all of Grand Island; Raymond W. Conant, Hastings; William R. Farrall, Grand Island, all of Nebr.

[73] Assignee: Farrall Instruments, Inc., Grand Island, Nebr.

[21] Appl. No.: 676,931

[22] Filed: Mar. 27, 1991

[51] Int. Cl.[5] ..... A61G 7/06

[52] U.S. Cl. ..... 128/869; 340/573

[58] Field of Search ..... 340/573, 309.15; 128/630, 869–876

[56] References Cited

U.S. PATENT DOCUMENTS 4,020,482 4/1977 Feldl ..... 340/279
4,583,084 4/1986 Henderson et al. ..... 340/573
4,777,944 10/1988 Green et al. ..... 128/874
4,947,152 8/1990 Hodges ..... 340/573

FOREIGN PATENT DOCUMENTS 2532173 3/1984 France ..... 128/689

*Primary Examiner*—Kyle L. Howell
*Assistant Examiner*—Robert L. Nasser, Jr.
*Attorney, Agent, or Firm*—Welsh & Katz, Ltd.

[57] ABSTRACT

A system for monitoring the application and removal of physical restraints such as straps that may be used to restrain a patient in an institution or other medical facility, and recording data relating to the application and removal of such restraints. The system includes one or more portable monitoring units, each of which can be used for any one patient at a time, with the system including as many monitoring units as are necessary for the facility that uses such physical restraints. The monitoring units provide an accurate record of the times and dates during which each application and removal of such restraints are carried out.

56 Claims, 25 Drawing Sheets

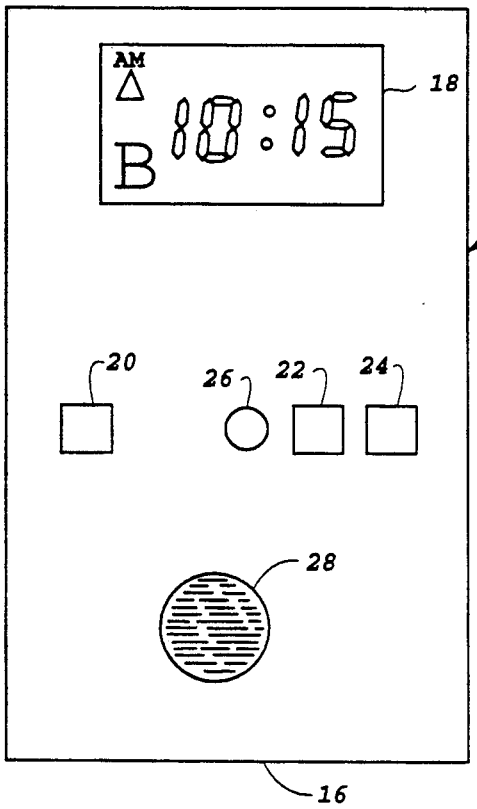
Fig 1
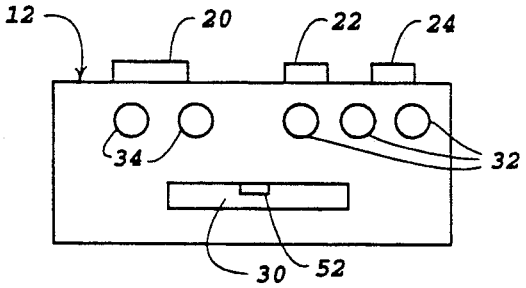
Fig 2
Fig 4
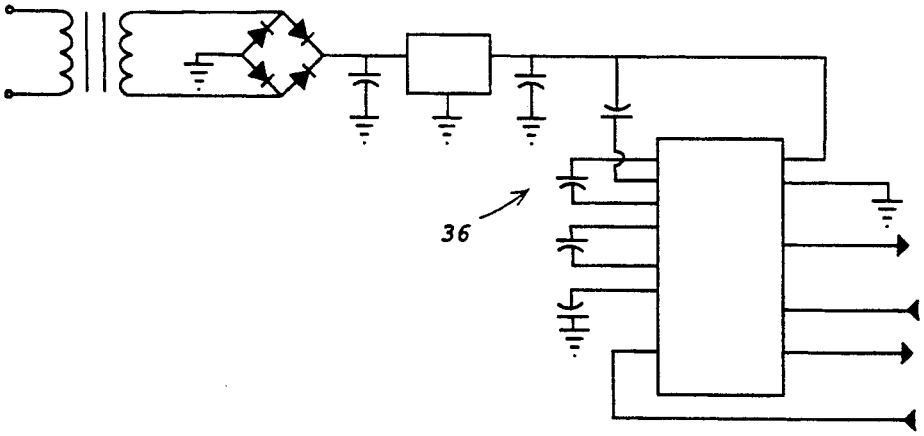

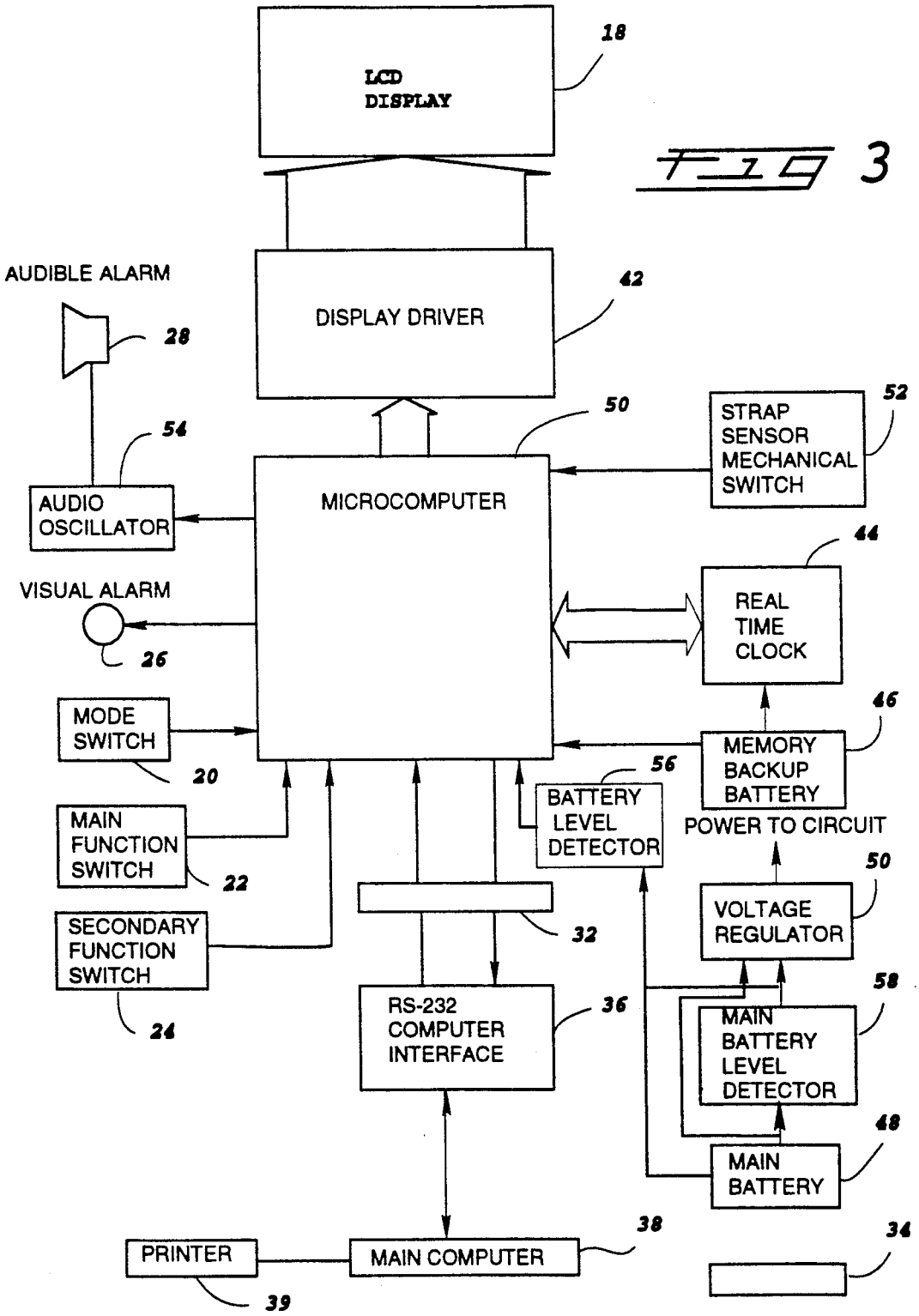
LCD DISPLAY
18
Fig 3
AUDIBLE ALARM
28
DISPLAY DRIVER
42
50
STRAP SENSOR MECHANICAL SWITCH
52
54
AUDIO OSCILLATOR
MICROCOMPUTER
44
VISUAL ALARM
26
REAL TIME CLOCK
46
MODE SWITCH
20
MEMORY BACKUP BATTERY
56
BATTERY LEVEL DETECTOR
POWER TO CIRCUIT
MAIN FUNCTION SWITCH
22
50
VOLTAGE REGULATOR
32
SECONDARY FUNCTION SWITCH
24
58
RS-232 COMPUTER INTERFACE
36
MAIN BATTERY LEVEL DETECTOR
48
MAIN BATTERY
38
34
PRINTER
MAIN COMPUTER
39

Main Routine

Begin
Display Menu
New File Option Chosen ?
Y
N
Call New-File Routine
Load File Option ?
Y
N
Call Load-File Routine
Save File Option ?
Y
N
Call Save-File Routine
Backup Patient Files ?
Y
N
Backup Data Files Routine
Format Data Disk Option ?
Y
N
Format Data Disk Routine
Exit to DOS Option ?
Y
N
Exit to DOS Routine
End
To Fig 12b

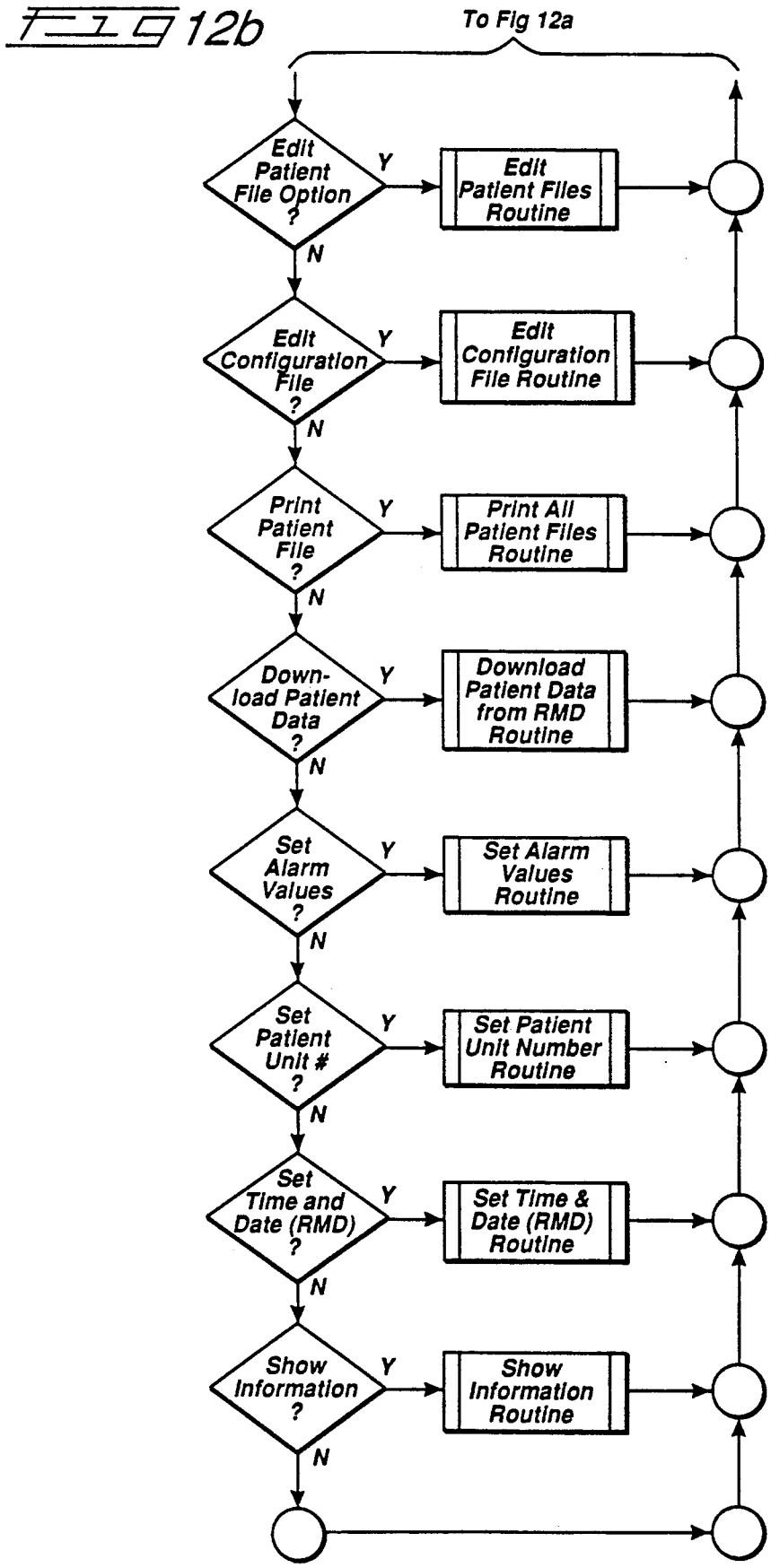
Fig 12b
To Fig 12a
Edit Patient File Option ?
Y
N
Edit Patient Files Routine
Edit Configuration File ?
Edit Configuration File Routine
Print Patient File ?
Print All Patient Files Routine
Down-load Patient Data ?
Download Patient Data from RMD Routine
Set Alarm Values ?
Set Alarm Values Routine
Set Patient Unit # ?
Set Patient Unit Number Routine
Set Time and Date (RMD) ?
Set Time & Date (RMD) Routine
Show Information ?
Show Information Routine Main Care Alert Firmware Routine Begin
Configure All Communication Ports
Reset All Reserved Memory Locations
Configure Real Time Clock
Mode Pressed ?
Y
N
Mode
Display Time
Main Function Pressed ?
Y
N
Display Date
Wait for 1/2 Second
Sec. Function Pressed ?
N
Y
12 Hour Mode ?
Y
N
Convert 24 Hour to 12 Hour Mode
Convert 12 Hour to 24 Hour Mode

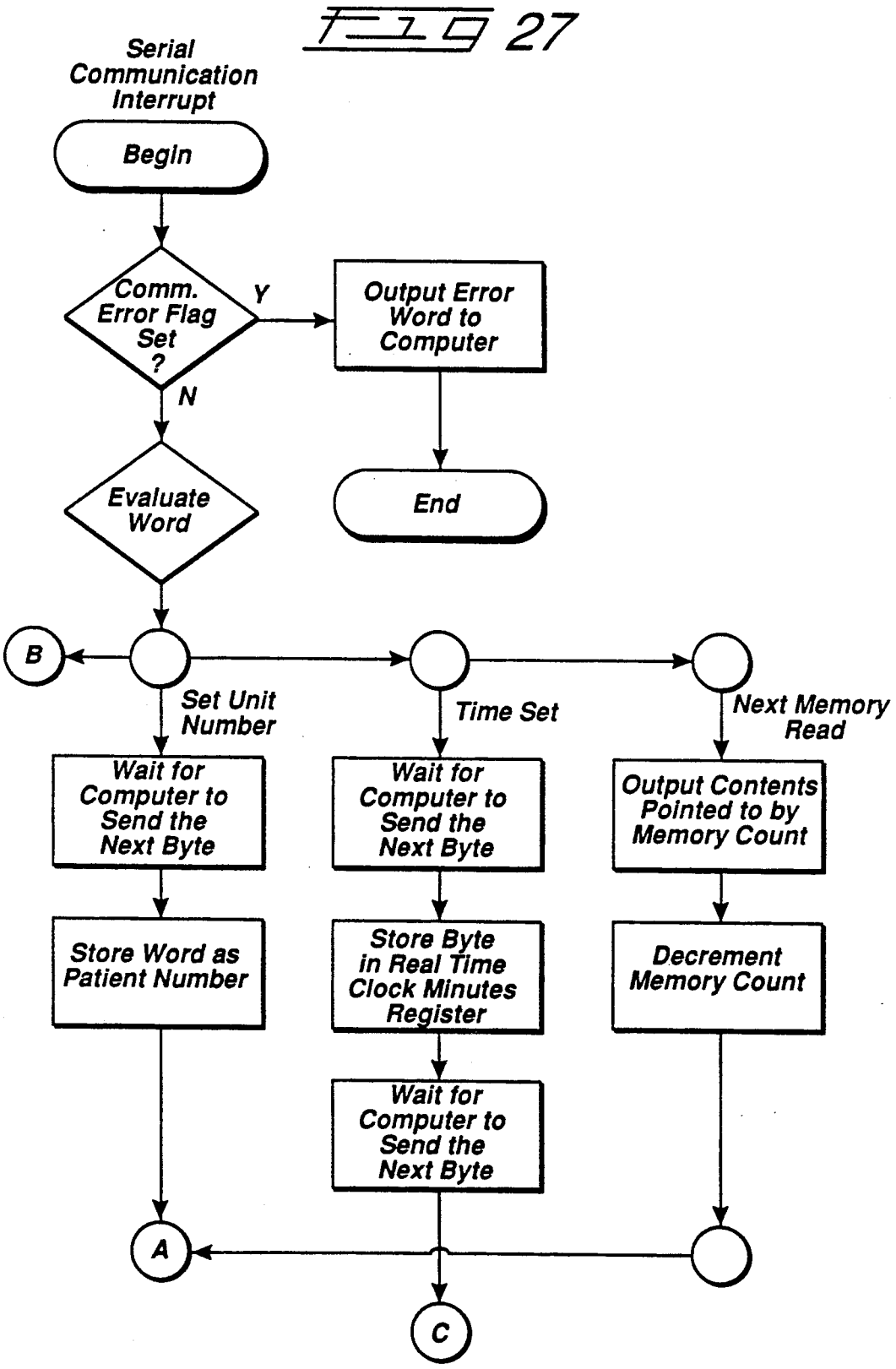
FIG 27
Serial Communication Interrupt
Begin
Comm. Error Flag Set ?
Y
N
Output Error Word to Computer
End
Evaluate Word
B
Set Unit Number
Time Set
Next Memory Read
Wait for Computer to Send the Next Byte
Wait for Computer to Send the Next Byte
Output Contents Pointed to by Memory Count
Store Word as Patient Number
Store Byte in Real Time Clock Minutes Register
Decrement Memory Count
Wait for Computer to Send the Next Byte
A
C

PHYSICAL RESTRAINT MONITORING SYSTEM

The present invention generally relates to medical monitoring equipment, and more particularly to a system which monitors and documents the application and release of physical restraint straps that may be applied to a patient in a medical facility or the like.

It is unfortunate but sometimes necessary from a practical standpoint to physically restrain some patients in institutions, hospitals or the like. Such restraints are generally in the form of thin flexible elongated straps that are attached to the bed and then applied to the patient. Health authorities recognize the need for such restraints with certain patients, but they dislike the ominous nature of them, since the patient is literally confined to the bed so that he cannot injure himself or others. Such departments, while permitting the use of such restraints nonetheless require that the patient be released after established intervals. Health authorities spend considerable resources to monitor facilities which use restraints to safeguard the interests of the patients so that they will not be literally strapped to their beds for extended periods of time. Some health authorities have guidelines which call for releasing the patients at least every two hours for a period of ten minutes and such health authorities often do investigations to insure that the restraints are released on a timely basis. If they determine that a facility is not removing the restraints from patients after the specified time interval, they have been known to impose severe penalties in the form of fines or the like, which are intended to insure humane treatment of the patients.

While most facilities have the best of intentions, they may not have sufficiently large staff to insure that every restrained patient has their restraints removed at the end of the prescribed interval. Also, even though a facility may have an adequately sized staff and may operate with the legitimate intention of releasing restraints within the prescribed time periods, it is of course possible that a patient will be overlooked and the restraints will not be removed within the specified time.

Accordingly, it is a primary object of the present invention to provide an improved restraint monitoring system which greatly facilities achieving the facility's goals of releasing the patient from restraints within the prescribed time periods, as well as the health authority's verification that such goals are being achieved.

It is another object of the present invention to provide such a monitoring system which not only alerts the facility that it is time to remove a restraint from a patient, but records the time of application and release of restraints in the form of a permanent record that can be reviewed by a health authority or the like.

It is still another object of the present invention to provide such a system which has a monitoring unit that is applied to the restraints that are placed on a patient and wherein release of the restraint is absolutely required or the time of release will not be recorded by the system.

Still another object of the present invention lies in the provision of having an elongated flexible restraint strap pass through an opening in the monitoring unit, the initial insertion of which operates a switch, which results in the time and date of such insertion being recorded by the monitoring unit. Subsequent removal of the restraint from the opening also operates the switch and the time and date of the removal of the restraint is also recorded.

Still another object of the present invention is to provide an improved system having such individual monitoring units that are applied to individual patients, but also having a central computer which is adapted to be connected to the individual monitoring units and receive the data therefrom, which data can be kept in a permanent record relating to each patient and the permanent record can be made available to health authorities to demonstrate that the facility is actually removing restraints in a timely manner.

A related object lies in the provision of encryption of the time and date information relating to application and removal of restraints on individual identified patients so that the data cannot be manipulated.

A more detailed object is to provide an improved system that includes a number of individual monitoring units wherein the monitoring units include their own processing means and memory and the units detect the application and removal of restraints and record each of the times and dates during which such events occur, so that the monitoring units are self-contained and portable. The monitoring units can be easily used by technicians or health care personnel, in that the monitor straps may be inserted through the opening before the strap is secured, and after removal of the restraint, the strap can be easily pulled from the opening.

Another detailed object of the present invention is to provide such a system having such monitoring units wherein each monitoring unit includes an alarm which will go off before the restraint time interval has elapsed to thereby alert the health care personnel that the monitor should be removed.

A corollary object lies in the provision of having an alarm that is visual that is activated at a predetermined time before the lapsing of the restraint interval and which provides an audio alarm once the restraint interval has expired.

Another object of the present invention is to provide alternative embodiments in which the monitoring units communicate with the main computer via a radio or light link.

Yet another object of the present invention is to provide another alternative embodiment in which the monitoring units communicate with the main computer via a radio link, and the monitoring units are simplified in that no processing means is contained within them, and the units merely send information relating to the application and removal of the physical restraints, and the main computer then records the time of such events.

These and other objects will become apparent upon reading the following detailed description of the present invention, while referring to the attached drawings, in which:

FIG. 1 is a plan view of a individual monitoring unit embodying the present invention;

FIG. 2 is an end view of the monitoring unit illustrated in FIG. 1;

FIG. 3 is a block diagram of the electrical circuitry of each of the individual monitoring units;

FIG. 4 is an electrical schematic diagram of the computer interface illustrated in the block diagram of FIG. 3;

Figure 8:
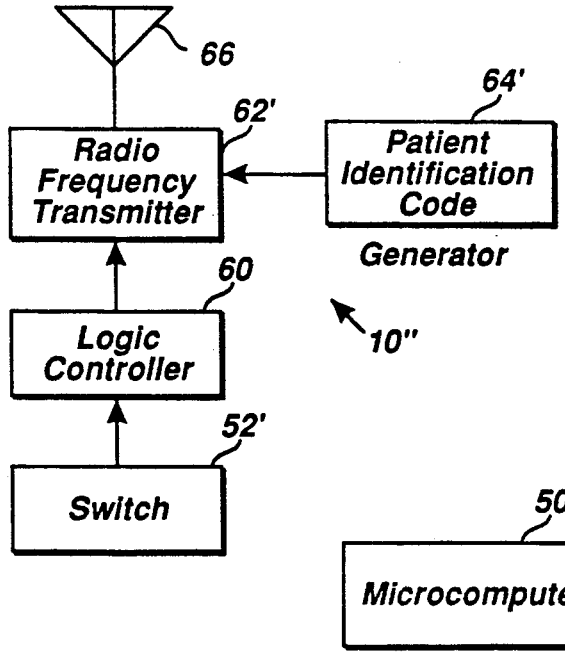
FIG. 8 is a block diagram of an alternative embodiment of the present invention and particularly illustrating a monitoring unit that has a radio communication link.
Figure 11:
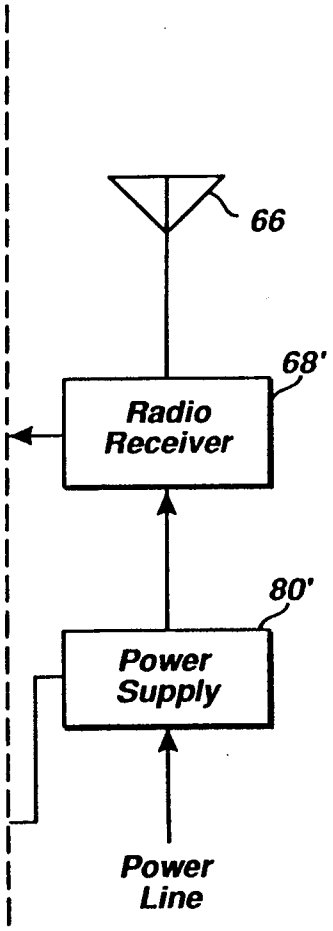

FIG. 11 is a block diagram of electrical circuitry for a central station and is another alternative embodiment of the present invention, and utilizes a radio communication link to monitoring units of the type illustrated in FIG. 8; and, FIGS. 12-25 illustrate flow charts of the instructions that are programmed in the main computer of the preferred embodiment; and, FIGS. 26-31 illustrate flow charts of the instructions that are programmed in the processing means of the individual monitoring units of the preferred embodiment.

Detailed Description

Broadly stated, the present invention is directed to a system for monitoring the application and removal of physical restraints such as straps that may be used to restrain a patient in an institution or other medical facility, and recording data relating to the application and removal of such restraints. More specifically, the system includes one or more portable monitoring units, each of which can be used for any one patient at a time, with the system including as many monitoring units as are necessary for the facility that uses such physical restraints.

The restraints are typically in the form of flexible straps which are applied to hold a patient at a desired location, but may have other forms. The present invention can be adapted to receive restraints having such other forms, by altering the size of the opening to accommodate such restraints. Health care personnel generally apply such straps and then are required to remove them within a predetermined time interval, which may vary from jurisdiction to jurisdiction, but which is typically approximately two hours. If the restraint must be used for a patient, then most health authorities require that they be removed every two hours for a minimum period of approximately ten minutes before they are reapplied. As long as the monitoring units are applied to each patient which is restrained, the monitoring unit provides an accurate record of the times and dates during which each application and removal of such restraints are carried out. Moreover, the system includes encryption means which prohibits tampering with the data once it has been monitored and recorded. In this regard, the data is preferably encrypted according to the Data Encryption Standard as described in Federal Information Processing Standards Publication FIPS PUB 46-1 which supersedes FIPS PUB 46 1977 Jan. 15, which is specifically incorporated by reference herein.

Turning now to the drawings and particularly FIG. 1, a monitoring unit 10 of the preferred embodiment is illustrated which has a generally rectilinear enclosure 12 with a front face 14 and a lower end 16 (FIG. 2). In the front face 14, there is a display 18, a mode switch 20, a main function switch 22, a secondary function switch 24, as well as a visual alarm 26 and an audio alarm 28.

As is shown in FIGS. 1 and 2, there is an opening 30 near the bottom of the enclosure and preferably extending end to end, through which the flexible restraint may be passed during application of the restraint. While it is preferred that the opening be end to end, the opening may extend from side to side, but it is believed that the end to end orientation provides the most advantageous stability for the unit when it is applied.

The enclosure is compact and easily portable and has an overall size of preferably approximately $2\frac{3}{4}''$x$4\frac{1}{4}''$ and has a thickness of approximately 2 inches. Each of the monitoring units 10 has a set of connectors 32 located on the bottom thereof and adapted to contact cooperative connectors in a computer interface 36 that is preferably enclosed in a stand and the computer interface 36 is connected to a main computer 38. The monitoring unit may also have a pair of connectors 34 for connection to a battery charger in which the unit may be placed to recharge the batteries thereof. When the unit is removed from a patient, it can be placed in the computer interface stand 36 and the data from the internal memory of the monitoring unit can be transferred to the memory of the main computer 38 as part of the permanent record keeping function that the system performs. The main computer is preferably an IBM or compatible personal computer, although other computers may be utilized, and it has a display, a keyboard, and preferably a disc drive having sufficient capacity to store the data generated during operation. The main computer also preferably has a printer 39 associated therewith for printing reports.

Turning now to the block diagram of FIG. 3, the monitoring unit 10 includes a processing means 40 which preferably comprises a micro-controller and is preferably a Motorola Model No. MC68HC05C4FN which is connected to a display driver integrated circuit 42 that is preferably a Model MM5452V manufactured by the National Semiconductor Corporation. The display driver integrated circuit 42 drives the display which is preferably a liquid crystal display which is a four digit display model LTD 203 as manufactured by Philips. The display also preferably has an indicator which indicates whether the time is "a.m." or "p.m." and has a second indicator, preferably the letter "B" which indicates that the battery of the unit is detected to be low. The processing means 40 is driven by a real time clock circuit 44, which is preferably a model MC68HC68T1DW manufactured by Motorola and it provides the clock signal for driving the processing means 40. The real time clock 44 is powered by a memory back-up battery 46 which also powers the processing means 40 and internal memory but otherwise does not provide the sufficient power for operating the monitoring unit in its normal operation. A main battery 48 which is connected to a voltage regulator 50 powers the circuitry.

The monitoring unit has a mechanical switch 52 which is preferably a micro-switch Model No. 311SM4-

T manufactured by Micro Switch Corporation and it is positioned within the enclosure within the opening 30 so that when the restraint strap is inserted in the opening, it will operate the switch 52 which is connected to a port in the microprocessing means, and the switch 52 is also operated again when the restraint strap is removed from the opening. The micro-controller drives the visual alarm 26 which is preferably a light emitting diode (LED) and it is also connected to an audio oscillator circuit 54 which drives the audio alarm 28 which may be a piezoelectric alarm or a common speaker, such as a Mauser speaker Model 25RF006.

When the battery level detector 56 detects that the voltage level of the battery 48 drops below a predetermined value, it provides the signal to the processing means 40 which causes it to signal the display driver 42 to illuminate the "B" symbol indicating that the battery is becoming discharged. The monitoring unit also includes a second main battery level detector 58 which also monitors the main battery and if it detects a voltage level below a predetermined value, then it turns off the voltage regulator 50 and thereby shuts down the operation of the monitoring unit. However, as previously described, the memory back-up battery 46 which is also connected to the micro-controller and to the real time clock will keep the processing means 40 powered sufficiently so that the data in its memory will not be destroyed. The unit can then be removed and transferred to the battery charger.

Figure 5:
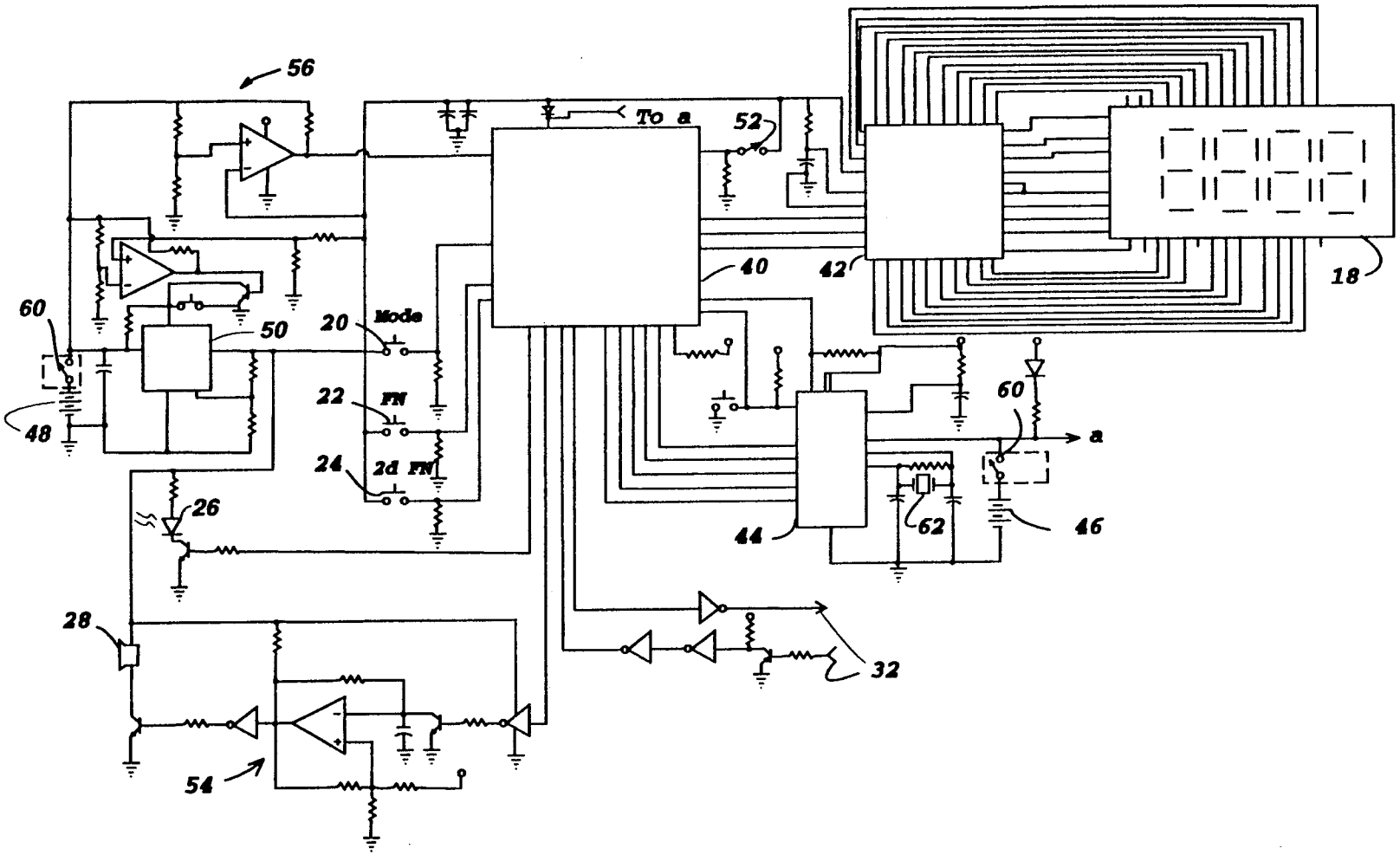
FIG. 5 is an electrical schematic diagram of the circuitry shown in the block diagram of FIG. 3, except for the computer interface portion thereof.

Referring to FIG. 5, the specific electrical schematic circuit diagram is illustrated which carries out the operation of the block diagram that has been described. The components that have been identified in FIG. 3 are also illustrated in FIG. 5 with the same numerical designations.

While the circuitry of FIG. 5 will not be specifically described inasmuch as its operation will become apparent to one of ordinary skill in the art, given the previous description of the block diagram of FIG. 3, except for the following comments.

A double pole switch 60 is preferably provided, and one pole of the switch is connected to each of the respective batteries 46 and 48 to interrupt power to the monitoring unit. This switch is preferably located inside of the enclosure 12 or at a location that is not easily accessible for operation and is intended to be a switch which prevents power from being applied to the circuitry during shipment or the like. Once the monitoring unit is to be placed into operation, the switch will be switched on to conduct voltage to the circuitry and also permit the battery to be charged for initial operation.

With respect to the display 18, the four digit display is adapted to indicate the time and date and it also has a small diamond shape indicator at the upper left-hand corner which is intended to illustrate whether the time is "a.m." or "p.m." The nature of its operation is that an a.m. and p.m. designation will be painted on the outer surface of the display, such as by silkscreening or the like, and the diamond will be immediately below one of the two designations. If it is under the a.m. designation, then the diamond will be illuminated when the time is during the a.m. and it will be extinguished when the time is p.m.

The real time clock circuit 44 is connected to a crystal 62 which drives the clock and the crystal is preferably a 1.048576 mHz crystal, although any other frequency that is compatible with the drive frequency of the clock and processing means may be used. Each of the voltage detectors 56 and 58 are shown in the upper left corner of the circuitry of FIG. 5 and as is well known to those of ordinary skill in the art, the circuitry comprises voltage divider networks that are coupled to comparators which provide a high signal at their respective outputs when the detected voltage drops below a predetermined value as determined by the resistance values of the voltage divider network.

The processing means has an integral memory means which includes random access memory as well as read only memory. The random access memory is available for recording data indicating the time and date during which operation of the switch 52 occurred, which is indicative of the restraint strap either being inserted or removed from the opening 30 within the enclosure 12. The read only memory includes instructions for controlling the monitoring unit, which will now be functionally described.

After a monitoring unit has been charged and is to be placed into operation, the first step is to place an identification number for the unit so that the files for the various monitoring units can be associated with a particular patient within the main computer 38. If the unit is placed in the computer interface stand 36, the main computer can provide the identification number to the monitoring unit through appropriate keystrokes on the computer keyboard in accordance with the various modes of operation that are present in the software of the program which modes are functionally described in the flow charts of FIGS. 26–31. While it is possible that an identification number may be greater than 100, the present system utilizes a two digital identification number which indicates that up to 99 separate monitoring units may be used with the same main computer. If it is desired to designate the identification number at the monitoring unit itself, this is possible by pressing the mode switch 20 a second time and this places the monitoring unit in condition to designate its identification number, and is done by depressing the function switch 22 until the desired number is displayed by the display 18 which increments through the numbers one by one when the function switch 22 is depressed and released. When the unit has incremented to the desired number, then the mode switch 20 is pressed and the identification number that was shown on the display screen is then written into random access memory and the unit identification number is thereby designated.

Pressing the mode switch again places the processing means 40 in a time and date set mode which, upon depression of the function and secondary function switches enables the time and date to be reset. More specifically, in the preferred embodiment, the minutes are first set by depressing the main function switch until the display increments through the minutes, and when the correct minutes are display, the operator depresses the secondary function switch 24 which accepts the minutes, and then displays the hours. The main function switch 22 then can be depressed until the correct hours are display, and depressing the secondary function switch 24 then accepts the hours and the day of the month is then displayed. Similar setting of the correct day of the month then can be done, followed by the setting of the month.

Upon depression of the mode switch yet again, the display will show the time of the next set alarm, which will be the time of the conclusion of the current restraint interval. Depressing the mode switch again places the unit in a data transfer mode, which permits the data relating to the time and date of each application or removal of a restraint to be read via the LCD display using the main function switch to step through the time and/or date of each application or removal. Depression of the mode switch again puts the unit back into its normal operating mode during which time the current real time is normally displayed by the display. In order for the main computer to communicate with the monitor, the monitor must be in the normal operating mode. If it is in any other mode, it will not respond to the computer.

During normal operation, if the current date is to be illustrated, then depression of the function switch 22 will result in the date being displayed for a short time after which the display will revert to the real time display.

When the monitoring unit is placed on a patient, i.e., the strap is inserted through the opening 30, this operates the switch 52 and the processing means 40 records the time and date at which this event occurs. If the time duration for application of restraints is set at two hours, for example, the processing means 40 monitors the switch 52 and if the restraint strap has not been removed by the time that the restraint has been applied for approximately one hour and fifty minutes, the processing means 40 actuates the display 26 to turn it on, which alerts a technician observing the monitoring unit that the restraint time interval has almost expired. If the strap is removed, that event is recorded by the processing means 40 and the visual alarm 26 is then extinguished. However, if the restraint is still applied at end of the two hour interval, then the processing means 40 activates the audio alarm 28 which provides an audio indication to health care personnel that the restraint must be immediately removed.

It should be understood that the time duration during which the restraints may be applied can be varied, but this can only be performed by the main computer 38 and not by the monitoring unit itself. Similarly, the time period between the activation of the visual alarm 26 and the audio alarm 28 can be programmed, but this too can only be done by the main computer 38. Once the audio alarm is activated, it will preferably provide an intermittent buzzer that will continue until the restraint strap is removed. Once it is removed, that time and date is stored in memory and all alarms are then disabled.

It is preferred that the monitoring unit has sufficient random access memory to store approximately up to three days of history data of application and removal of the restraint straps, but a larger memory can be provided which would permit more data to be recorded and stored. When the memory space has neared its limit, the processing means 40 activates the visual alarm 26 but it is preferred that rather than a blinking light which is preferably provided in the event that a restraint time is nearing its limit, it will be continuous, which indicates that the memory is nearly full.

If the monitoring unit's memory is full or it is time to download data the monitoring unit must be removed from the patient and be placed in the computer interface stand 36 for the purpose of downloading the data.

Once the data is downloaded into the main computer 36, the main computer is adapted to generate reports which can provide a written history of the operation of the system. While the data relating to each application and removal of restraints cannot be changed because of the encryption technique used, there is a comment field on the preferred form of the report which can be edited. A preferred format for such reports is illustrated:

Institution: ABC Facility
Patient Identification: 123-45-6789
Patient Name: Doe, John
Unit Number: 01
Attending Physician: Dr. Robert Smith
Attending Nurse: Jane Jones
DATE OF REPORT: 01/23/1991

SUMMARY REPORT

| Restrained | | Released | | Elapsed Time | Elapsed Time | |
|---|---|---|---|---|---|---|
| Date | Time | Date | Time | Rest. | Rel. | Comments |
| 01/21 | 8:12 | 1/21 | 9:12 | 1:00 | 0:17 | Shift change |

The flow charts which are used by the main computer 38 and by the processing means 40 describe the instructions which are executed in the various modes of operation of the system. The flow charts shown in FIGS. 12–25 are those which are carried out during the operation of the main computer, while the flow charts illustrated in FIGS. 26–31 are those which are carried out by the processing means 40 in the monitoring units themselves. The flow charts are self-explanatory to those of ordinary skill in the art and carry out the operation of the processing means 40 and main computer as has been previously described. The blinking character of the visual display 26 as well as the duration of the intermittent buzzer tones is preferably set for approximately ¼ second, but the time duration for such video and audio alarms can be varied, if desired.

Figure 6:
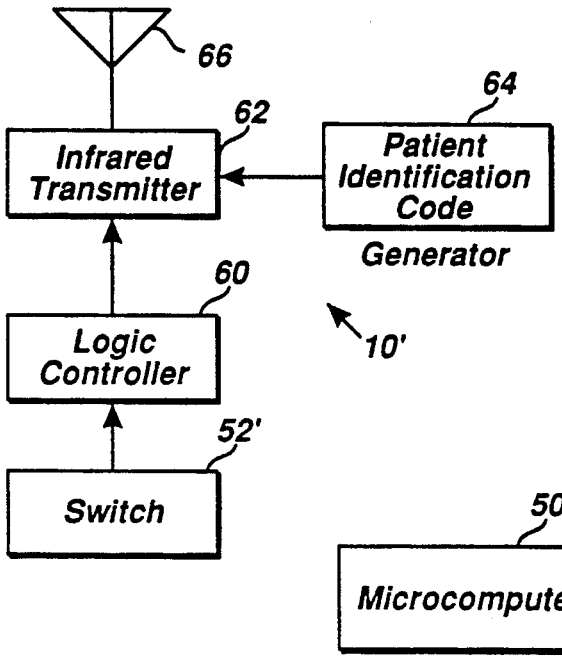
FIG. 6 is a block diagram of an alternative embodiment of the present invention and particularly illustrating a monitoring unit that has a light communication link.

In accordance with another aspect of the present invention, another embodiment of the monitoring system is illustrated in FIG. 6, which is a block diagram of an individual monitoring unit 10' of greater simplicity and less cost. In this embodiment, the monitoring unit has an enclosure (not shown) that is substantially similar to the enclosure 12 shown in FIG. 1 and has an opening similar to the opening 30 in FIG. 2 through which the restraint strap can be inserted. A switch 52' is provided and it is connected to a logic controller 60 which generates a signal indicating that the switch was closed or opened corresponding to insertion or withdrawal of the restraint strap. That signal is applied to an infrared transmitter 62 which transmits the signal via an antenna 66 to a receiver that is connected to either the main computer or to a nurses station or the like located in the general area of the patients. Each of the monitoring units also have a patient identification code generating circuit 64 which produces an identification signal which identifies each of the monitoring units 10'. The identification code generator 64 is connected to the transmitter 62 so that the transmitter can transmit the event of a switch operation and the identity of the monitoring unit which had the event, and that information is then received and recorded in memory.

Figure 7:
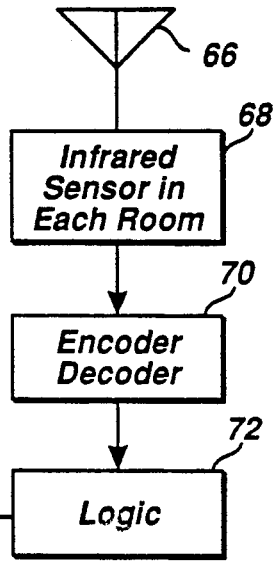
FIG. 7 is a block diagram of a portion of electrical circuitry for a central station and is an alternative embodiment of the present invention, and is for use with the embodiment illustrated in FIG. 6.

If the area in which the monitoring units is large or the units are in separate rooms, an infrared sensor is preferably positioned in each room or in various locations of a large open ward, there being a sufficient number to ensure that all transmitted signals are received by a receiving station. The sensors are preferably hard wired to the receiving station. In this regard, the block diagram of FIG. 7 illustrates a block diagram of portion of circuitry which is added to the circuitry shown in the block diagram of FIG. 1. The circuitry includes the sensor 68 which is connected to a decoder 70 and logic circuitry 72, which provide the identification data and whether the switch had been opened or closed in digital form for the microcomputer 50. The microcomputer then records this information in memory together with the time that the switch operation occurred.

Figure 9:
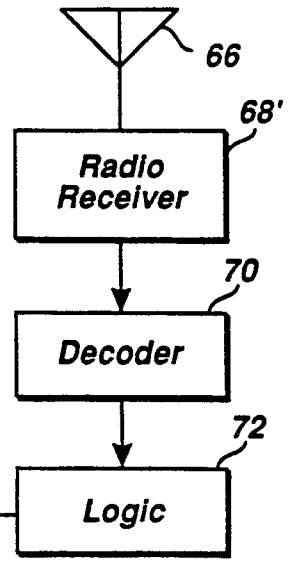
FIG. 9 is a block diagram of a portion of electrical circuitry for a central station and is an alternative embodiment of the present invention, and is for use with the embodiment illustrated in FIG. 8.

Another embodiment of the present invention is shown in FIGS. 8 and 9, which are substantially similar to the embodiments shown in FIGS. 6 and 7, except that the transmitter 62' and receiver 68' communicate by radio frequency transmission rather than infrared transmission.

Figure 10:
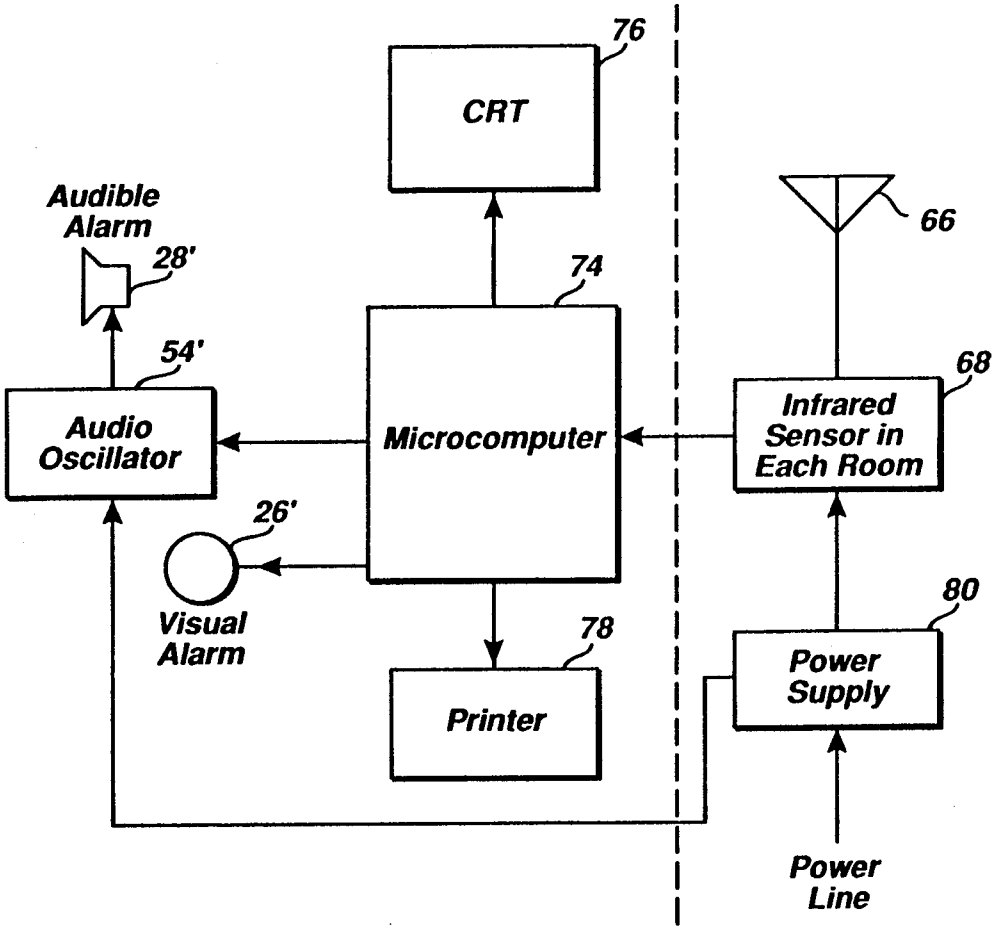
FIG. 10 is a block diagram of electrical circuitry for a central station and is another alternative embodiment of the present invention, and utilizes a light communication link to monitoring units of the type illustrated in FIG. 6.
Figure 12A:
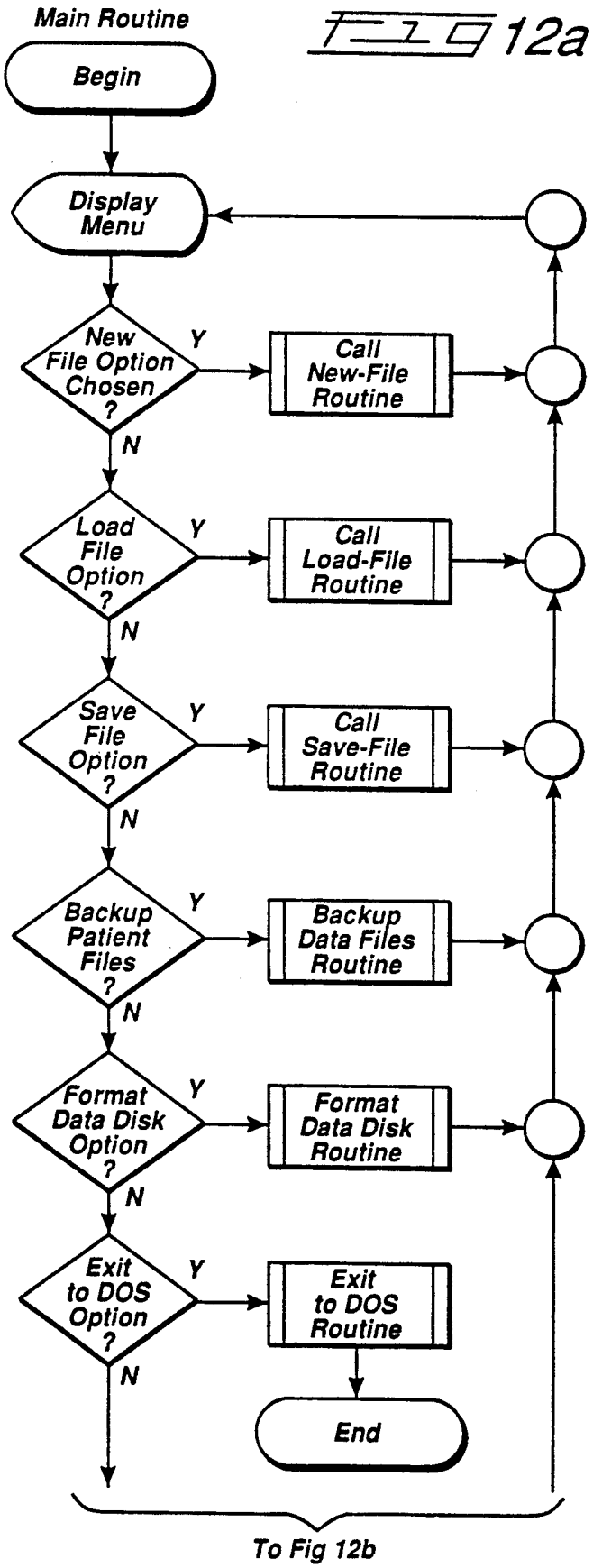
Figure 13:
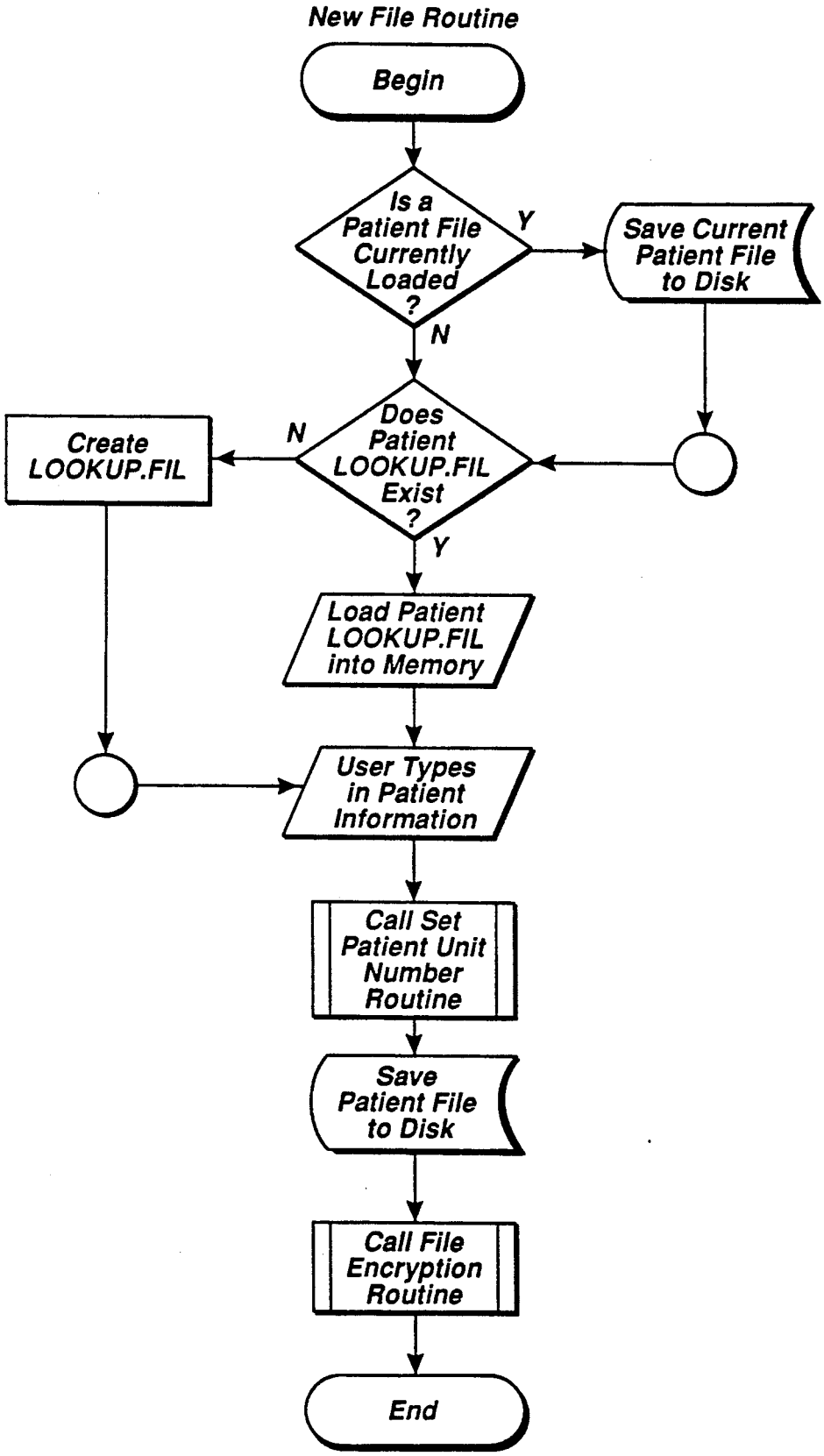
Figure 14:
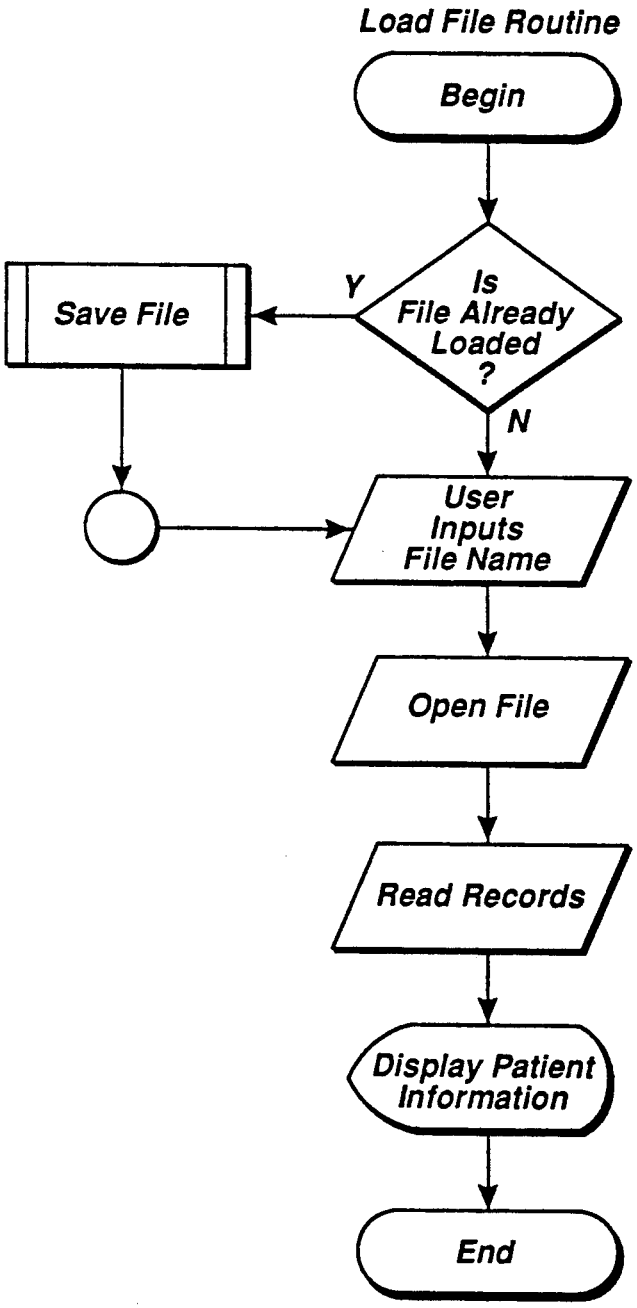
Figure 15:
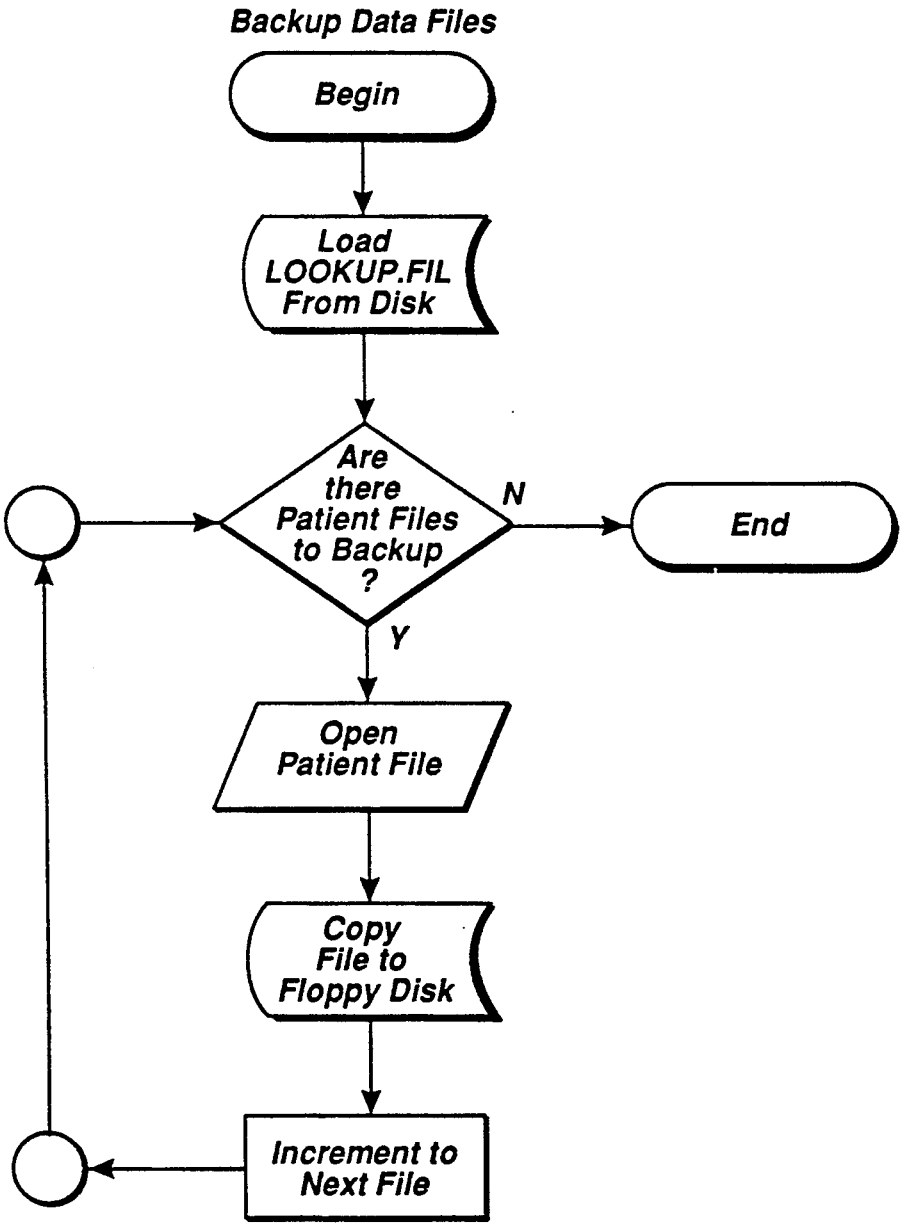
Figure 16:
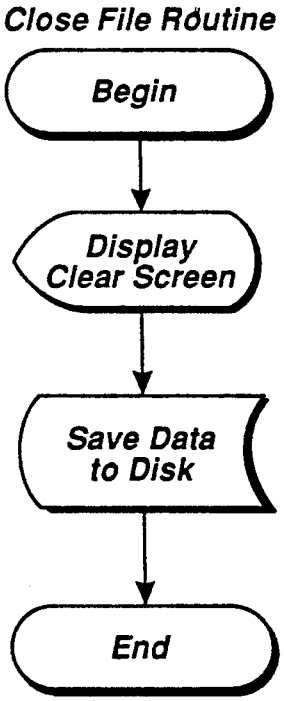
Figure 17:
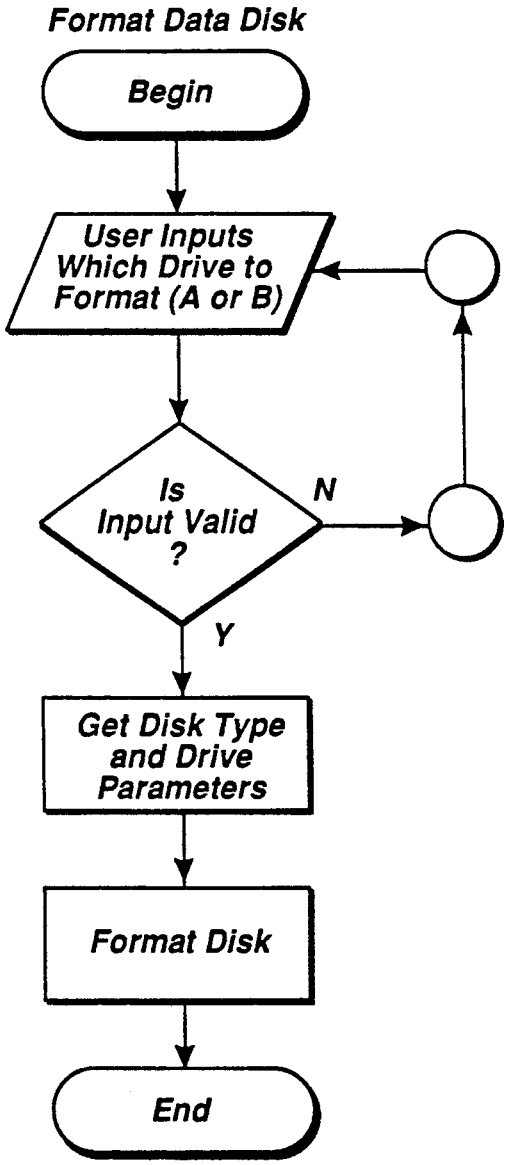
Figure 18:
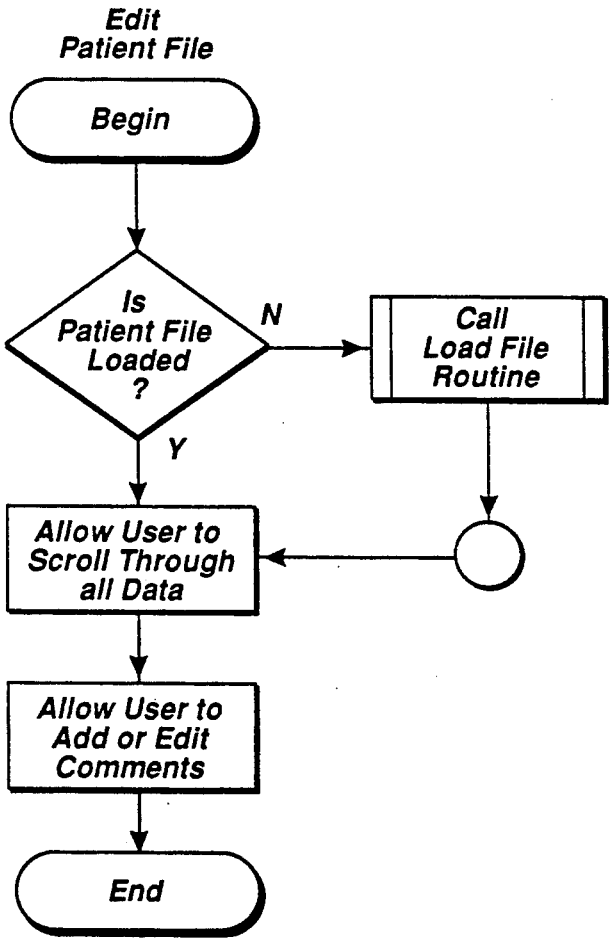
Figure 19:
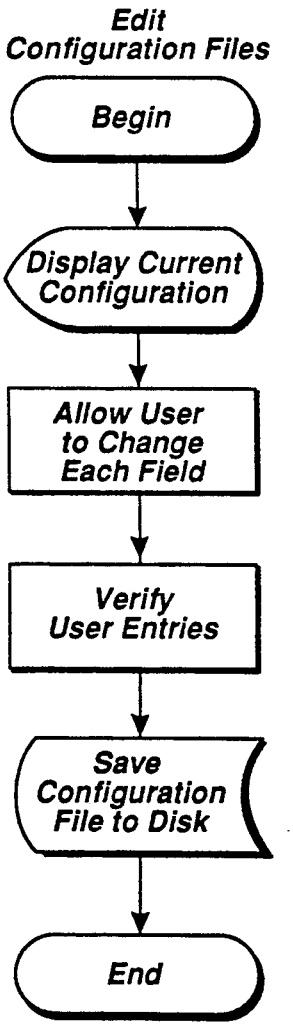
Figure 20:
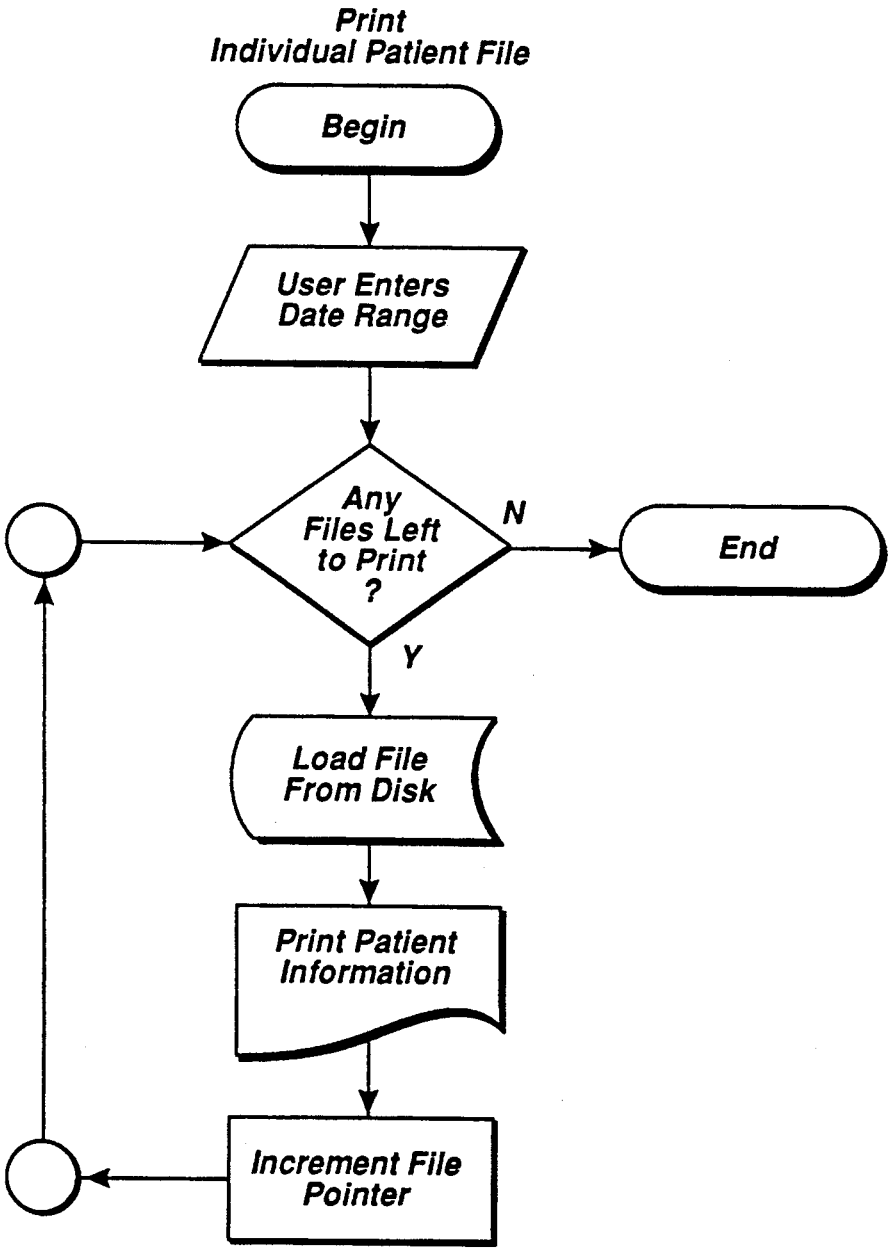
Figure 21:
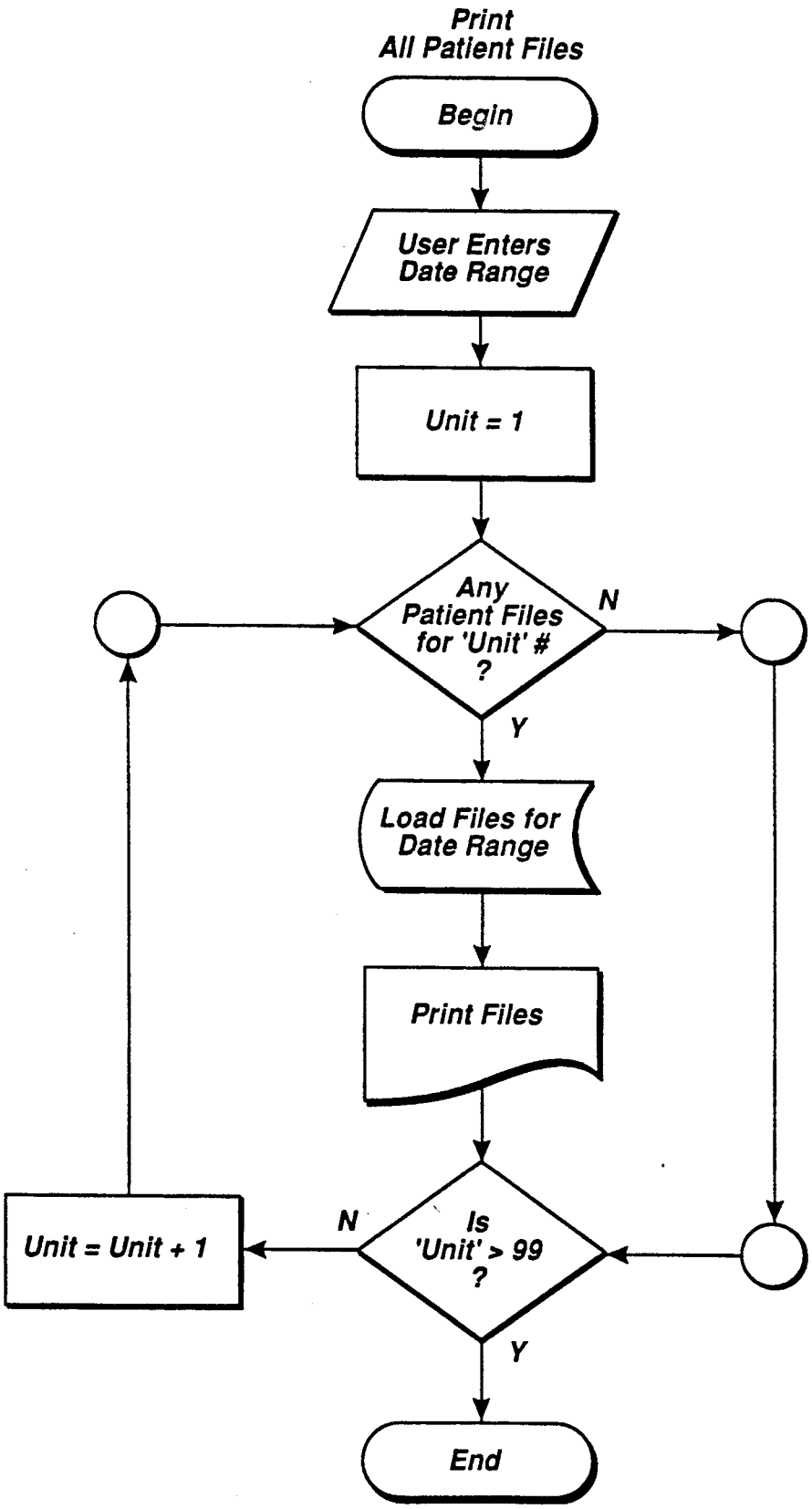
Figure 22:
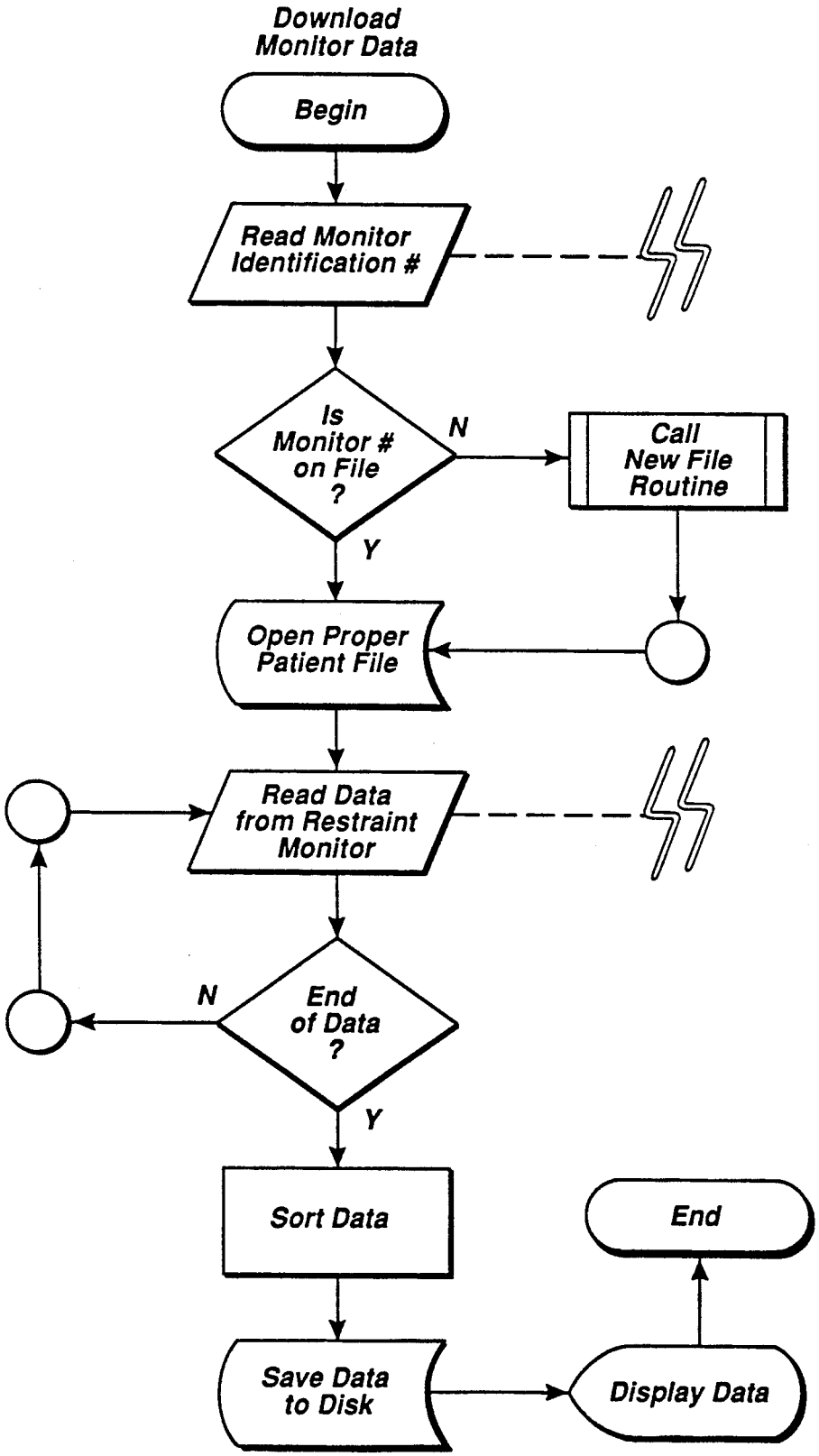
Figure 23:
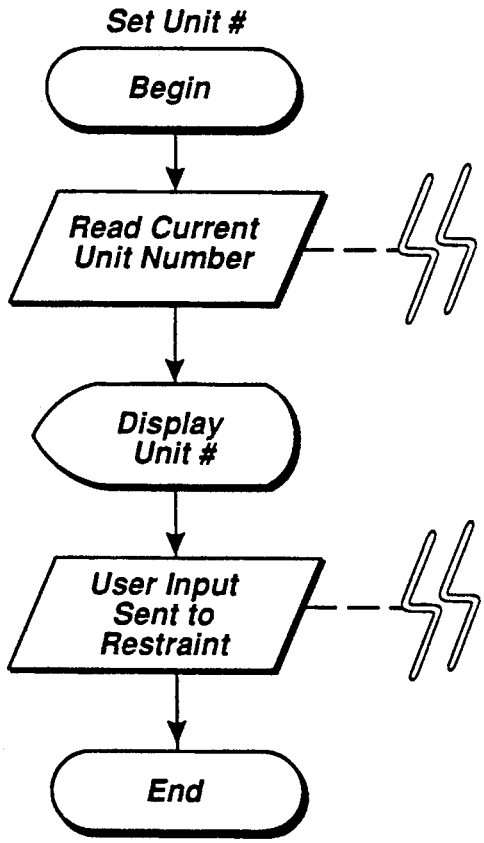
Figure 24:
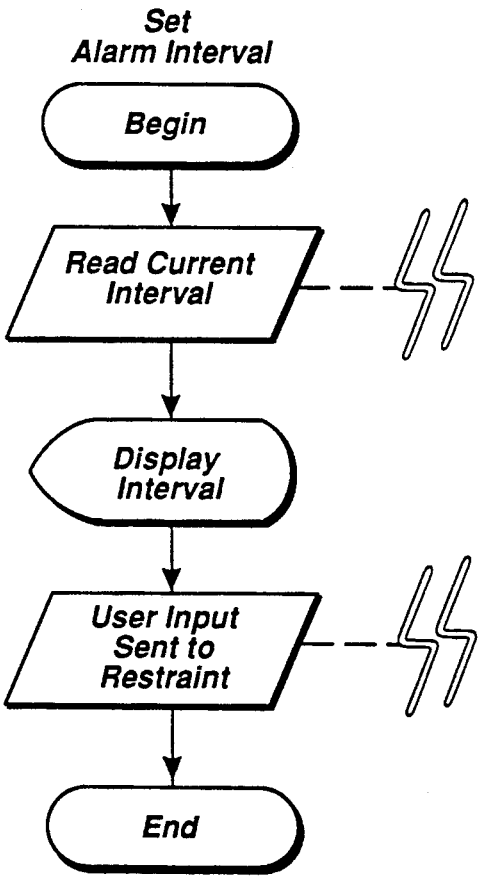
Figure 25:
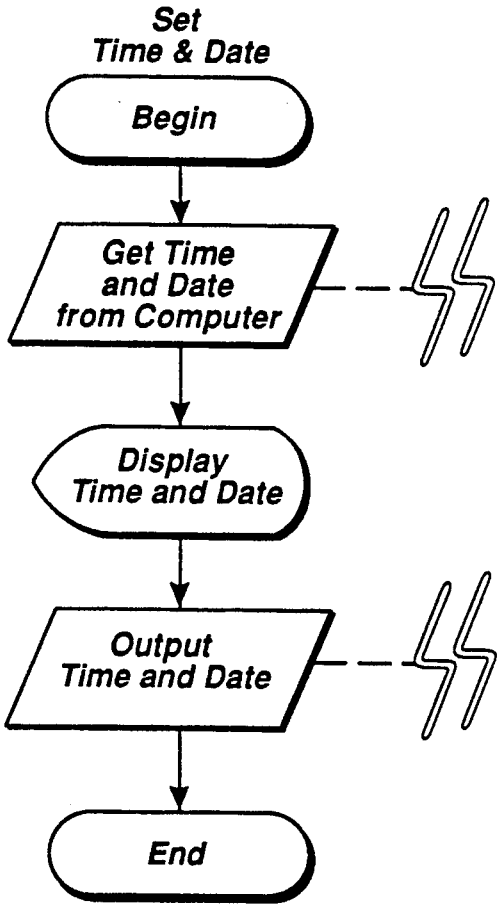
Figure 26:
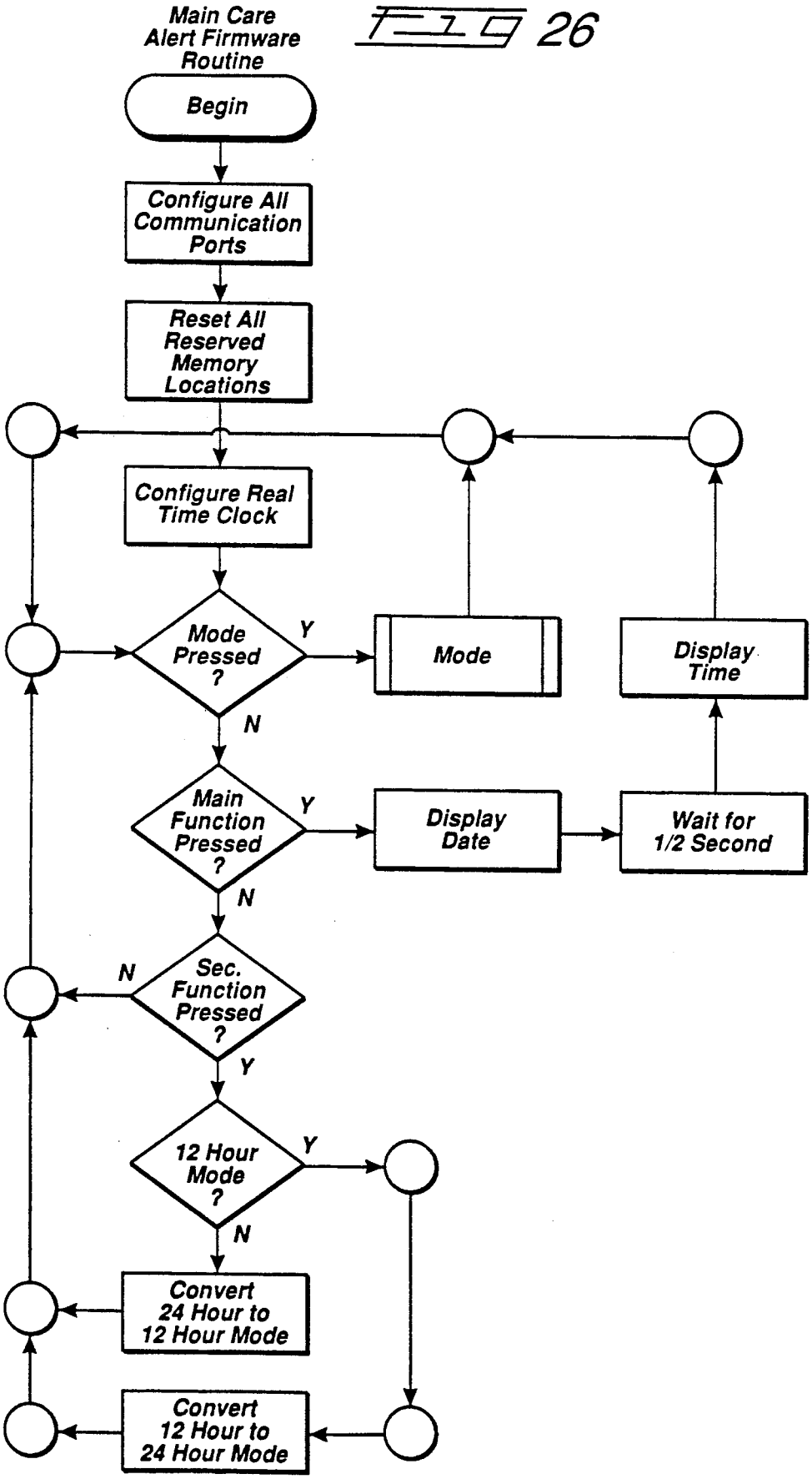
Figure 28A:
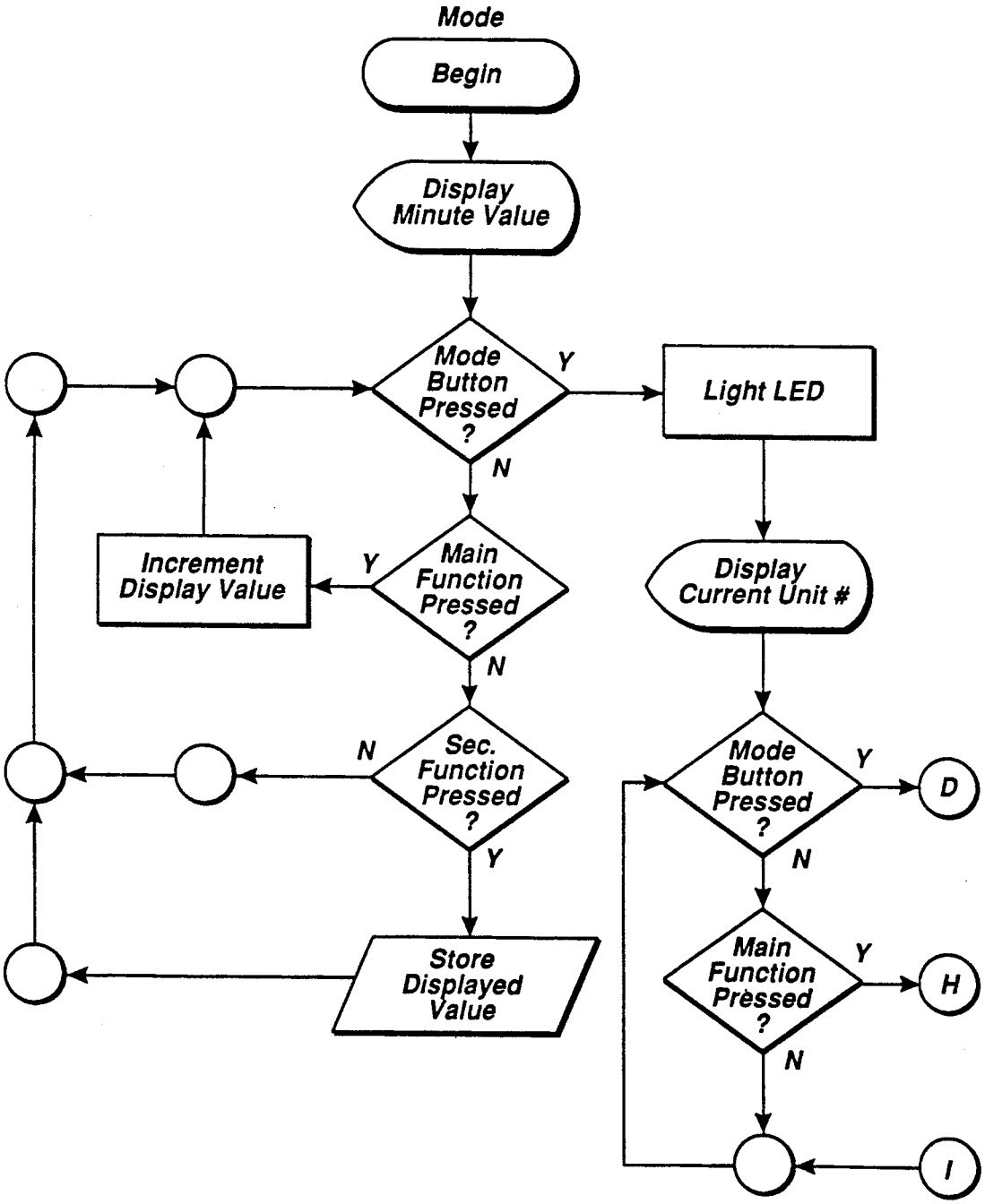
Figure 28B:
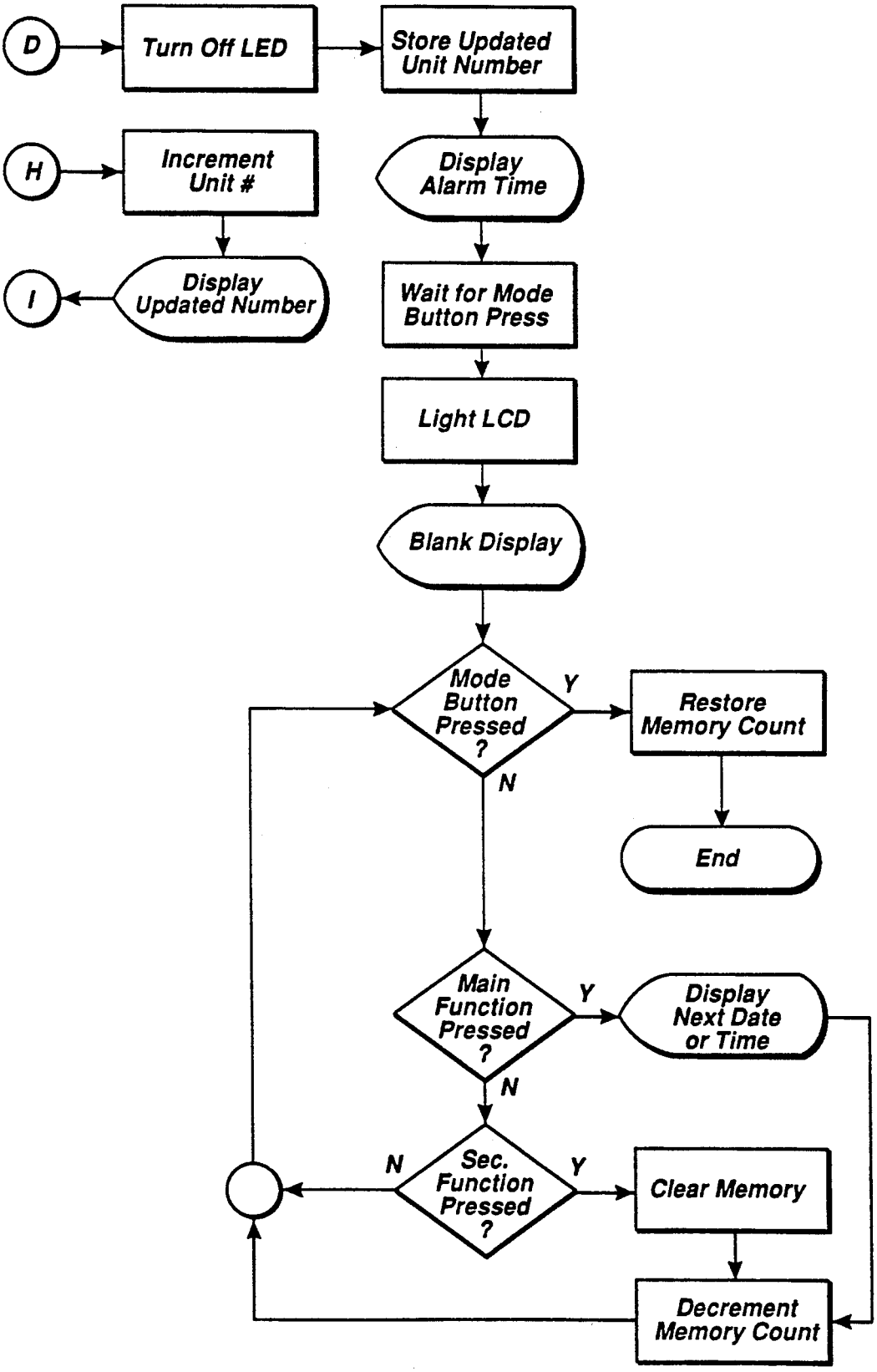
Figure 29:
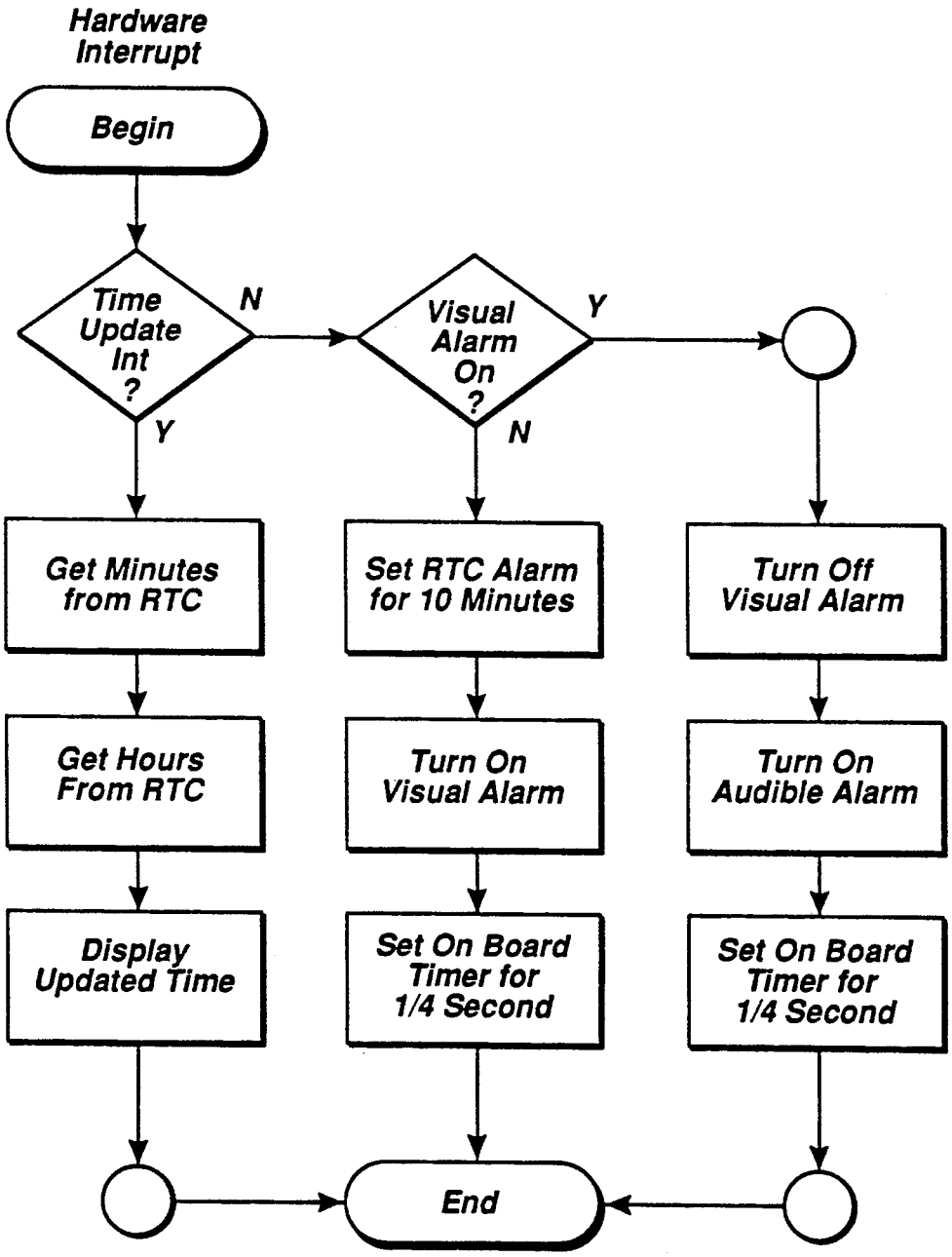
Figure 30A:
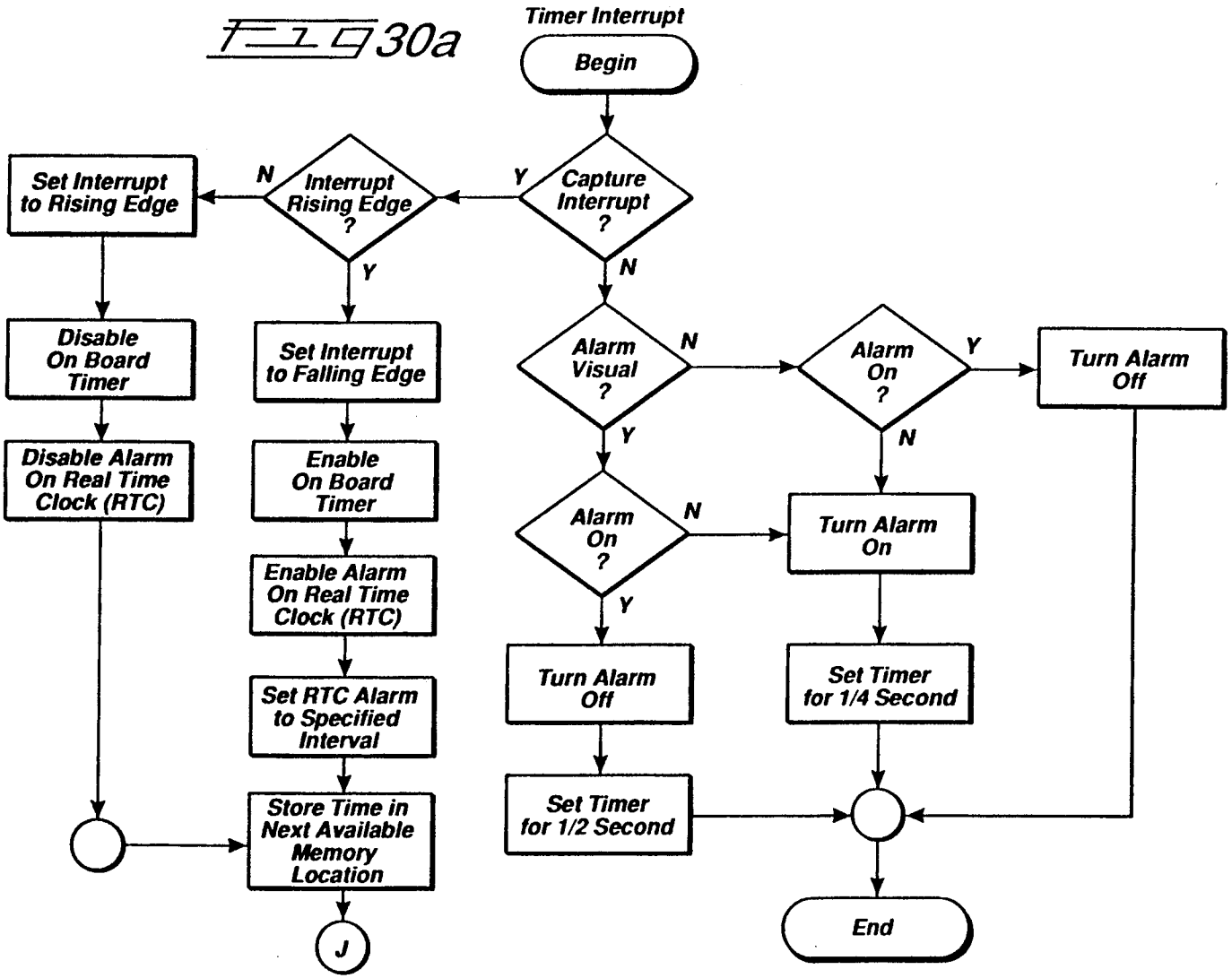
Figure 30B:
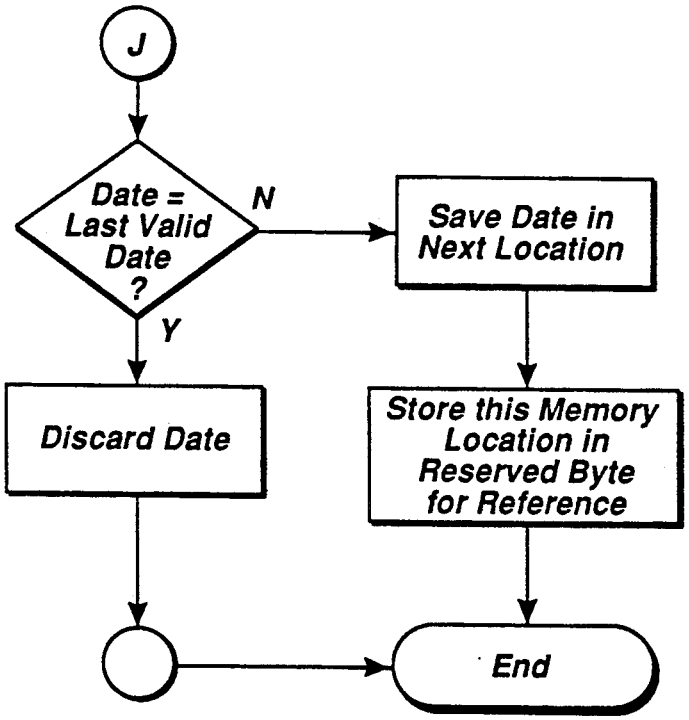
Figure 31:
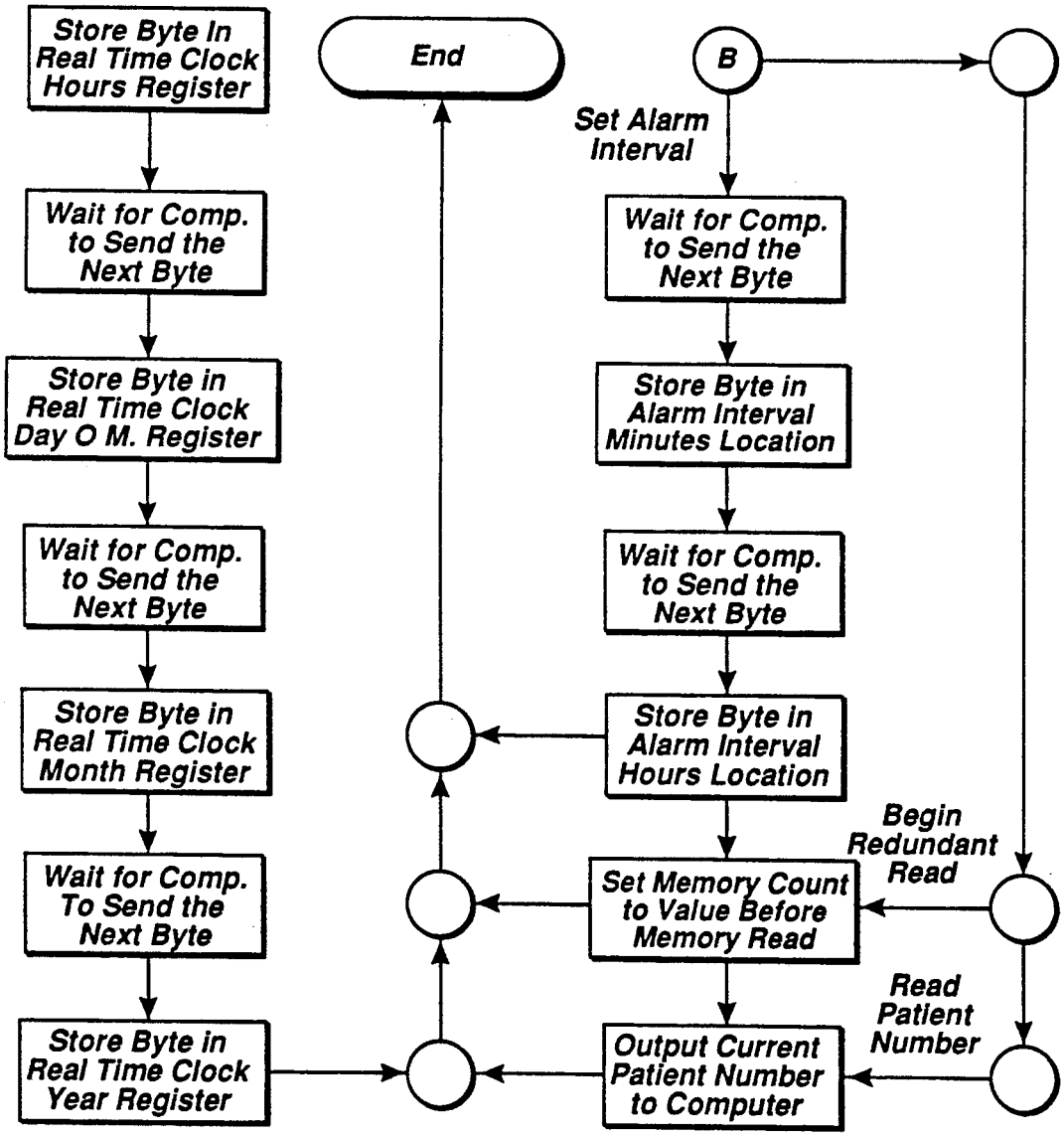

Yet another embodiment of the present invention is shown in FIGS. 10 and 11. The embodiment shown in FIGS. 10 and 11 are adapted for operation with individual monitoring units such as are shown in FIGS. 6 and 8. The information relating to the identity of the monitoring unit that is transmitting and the occurrence of a switch operation is received by the infrared sensor 68 (FIG. 10) or by the radio receiver 68' (FIG. 11) and the information is applied directly to a microcomputer 74 and has an associated CRT monitor 76 and printer 78. The microcomputer 74 is connected to an audio oscillator 54' and to a visual alarm 26' and is adapted to activate either of the audio or visual alarms for the reasons that have been previously described. This equipment may be located at a supervisory or nurses station, and there may be many individual monitoring units that would communicate with this equipment. It is contemplated that several of the embodiments of FIG. 10 would be present in a facility. Separation of the functionality for several of such embodiments is ensured by the choice of radio frequencies or by digital techniques that are well known in the art.

From the above description of the preferred and alternate embodiments, it should be understood that the invention is not limited by the type of transmission between the monitoring units and a receiving computing means.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. Apparatus for measuring the time durations of the application of an elongated flexible restraint to a patient and for making a record of such time durations, said apparatus comprising:

restraint switch means adapted to be operated by either of the insertion and removal of the elongated physical restraints, said restraint switch means being operably connected to a processing means;

said processing means including memory means for storing data and instructions relating to the operation of the apparatus, said processing means recording the time and date of operation of said restraint switch means in said memory means;

means operably connected to said processing means for inputting data relating to the operation and status of the apparatus;

means operably connected to said processing means for producing an alarm;

means for providing power for operating said apparatus; and, enclosure means for containing said restraint switch means, said enclosure means including an opening therein through which the elongated flexible restraint can be passed, the presence of said elongated restraint within said opening operating said restraint switching means.

2. Apparatus as defined in claim 1 further including a display means operably connected to said processing means for displaying data relating to the operation and status of the apparatus.

3. Apparatus as defined in claim 2 wherein said display means is located within said enclosure means.

4. Apparatus as defined in claim 3 wherein said display means comprises a liquid crystal display and includes at least a predetermined number of alpha-numerical characters for displaying the time of day and date of the month, and an indication denoting whether the time is a.m. or p.m.

5. Apparatus as defined in claim 2 wherein said display means is a CRT monitor and is located remotely from said enclosure means.

6. Apparatus as defined in claim 1 wherein said processing means is located within said enclosure means.

7. Apparatus as defined in claim 6 wherein said power providing means comprises a battery and circuit means for providing at least one regulated voltage level for powering said processing means.

8. Apparatus as defined in claim 7 wherein said power providing means further includes a main power switch for disconnecting said battery from said processing means.

9. Apparatus as defined in claim 7 wherein said circuit means includes means for measuring the voltage level of said battery and which provides a signal indicating that the voltage level of said battery is below a predetermined level.

10. Apparatus as defined in claim 9 wherein said processing means further includes means for causing said processing means to disable the operation of said display means, said mode switch and said function switches while maintaining said memory means, in response to said processing means receiving said signal indicating the voltage level of said battery is below said predetermined level.

11. Apparatus as defined in claim 9 wherein said processing means further includes means for causing said processing means to provide data to said display means to display an indication of said battery having a voltage level below said predetermined level in response to said processing means receiving said signal from said circuit means.

12. Apparatus as defined in claim 6 wherein said inputting means comprises an external connector operably connected to said processing means adapted to be connected to an external computing means for communicating data between said processing means and said computing means.

13. Apparatus as defined in claim 12 wherein said inputting means further comprises a mode switch, a main function switch and a secondary function switch.

14. Apparatus as defined in claim 13 wherein said processing means further includes means for causing said processing means to provide data to a display means to normally display the current time, said processing means providing data to said display means to display the current date in response to one of said function switches being actuated.

15. Apparatus as defined in claim 12 wherein said processing means further includes means for causing said processing means to be selectively placed in one of a predetermined number of operating modes wherein said processing means receives and transmits selected data relating to the identification, status and operation of the apparatus.

16. Apparatus as defined in claim 15 wherein said processing means may be placed in an identification mode, a time and date display mode, a data transfer mode, and an alarm set display mode.

17. Apparatus as defined in claim 16 wherein said processing means further includes means for causing said processing means to be placed in said identification mode wherein said processing means receives data which specifies the identification of the apparatus, said processing means being placed in said identification mode in response to a mode switch being selectively operated, said identification being inputted by operation of one of said function switches and accepted by the other function switch.

18. Apparatus as defined in claim 16 wherein said processing means further includes means for causing said processing means to be placed in said data transfer mode wherein said processing means transfers data from said memory means to the external computing means, said processing means being placed in said data transfer mode in response to said mode switch being selectively operated.

19. Apparatus as defined in claim 16 wherein said processing means further includes means for causing said processing means to be placed in said alarm display mode wherein said processing means provides data to said display means to cause said display means to display the time of said next set alarm, said processing means being placed in said data transfer mode in response to said mode switch being selectively operated.

20. Apparatus as defined in claim 1 further including means for providing a nonhardwired communication link between said processing means and said restraint switch means and means for generating a signal identifying said restraint switch means.

21. Apparatus as defined in claim 1 wherein said alarm producing means comprises a visual alarm.

22. Apparatus as defined in claim 1 wherein said alarm producing means comprises a audio alarm.

23. Apparatus as defined in claim 1 wherein said alarm producing means comprises an audio and a visual alarm.

24. Apparatus as defined in claim 23 wherein said processing means further includes means for causing said processing means to activate said alarm producing means after a first predetermined time period following operation of said restraint switching means caused by the insertion of said flexible restraint in said opening.

25. Apparatus as defined in claim 24 wherein said alarm producing means produces a visual alarm after said first predetermined time period.

26. Apparatus as defined in claim 24 wherein said processing means further includes means for causing said processing means to activate said alarm producing means at a second predetermined time period following operation of said restraint switching means caused by the insertion of said flexible restraint in said opening.

27. Apparatus as defined in claim 26 wherein said alarm producing means produces an audio alarm after said second predetermined time period, said second predetermined time period being longer than said first predetermined time period.

28. Apparatus as defined in claim 23 wherein said processing means further includes means for causing said processing means to activate said alarm producing means when the available capacity of said memory means is less than a predetermined value.

29. Apparatus as defined in claim 1 wherein said restraint switching means comprises a mechanically actuated electrical switch that is mounted within said opening and is adapted to be operated by the insertion and removal of said elongated flexible restraint.

30. Apparatus as defined in claim 1 wherein said processing means further includes means for recording data indicating the time and date of each operation of said restraint switching means in said memory means.

31. Apparatus as defined in claim 1 wherein said processing means further includes means for encrypting said time and date indicating data according to a predetermined algorithm so that such data cannot be easily manipulated without implementation of a security key.

32. A system for monitoring the application and removal of elongated flexible physical restraints of at least one patient and for recording data relating to such application and removal for each patient, said system comprising:

a main computing means including a memory means for storing instructions and data relating to the operation of the system, including data relating to the identification of individual monitoring units for patients having physical restraints and data recording the time and date at which said monitoring units detects either the removal and application of the physical restraints, at least one monitoring unit, each of said monitoring units further comprising:

restraint switch means adapted to be operated by either of the insertion and removal the elongated physical restraints, said restraint switch means being in communication with said main computing means;

enclosure means for containing said restraint switch means, said enclosure means including an opening therein through which the elongated flexible restraints can be passed, the presence of said elongated restraint within said opening operating said restraint switching means;

means for providing power for operating said unit;

one of said main computing means and said monitoring units further including:

display means operably connected to said processing means for displaying data relating to the operation and status of the unit;

means for inputting data relating to the operation and status of the system; and, means for producing an alarm.

33. A system as defined in claim 32 wherein each of said monitoring units includes a processing means including memory means for storing data and instructions relating to the operation of the unit, said processing means recording the time and date of operation of said restraint switch means in said memory means.

34. A system as defined in claim 32 wherein said computing means including connector means for connecting the same to individual monitoring units for transferring data and information therebetween.

35. A system as defined in claim 32 wherein said computing means includes printing means for selectively printing reports indicating the history of said removal and application of individual ones of said monitoring units.

36. A system as defined in claim 32 wherein said processing means further includes means for causing said processing means to activate said alarm producing means after a first predetermined time period following operation of said restraint switching means caused by the insertion of said flexible restraint in said opening.

37. A system as defined in claim 36 wherein said alarm producing means produces a visual alarm after said first predetermined time period.

38. A system as defined in claim 36 wherein said processing means further includes means for causing said processing means to activate said alarm producing means at a second predetermined time period following operation of said restraint switching means caused by the insertion of said flexible restraint in said opening.

39. A system as defined in claim 38 wherein said alarm producing means produces an audio alarm after said second predetermined time period, said second predetermined time period being longer than said first predetermined time period.

40. A system as defined in claim 39 wherein said main computing means sets said first and second predetermined time durations of each of said monitoring units by transferring data between said main computing means and said processing means when said monitoring unit is connected to said main computing means.

41. A system as defined in claim 32 wherein said display means further comprises a liquid crystal display.

42. A system as defined in claim 41 wherein said liquid crystal display includes at least a predetermined number of alpha-numerical characters for displaying the time of day and date of the month, and an indication denoting whether the time is a.m. or p.m.

43. A system as defined in claim 32 wherein said power providing means comprises a battery and circuit means for providing at least one regulated voltage level for powering said processing means.

44. A system as defined in claim 43 wherein said power providing means further includes a main power switch for disconnecting said battery from said processing means.

45. A system as defined in claim 44 wherein said inputting means further comprises a mode switch, a main function switch and a secondary function switch.

46. A system as defined in claim 45 wherein said processing means further includes means for causing said processing means to disable the operation of said display means, said mode switch and said function switches while maintaining said memory means, in response to said processing means receiving said signal indicating that the voltage level of said battery is below said predetermined level.

47. A system as defined in claim 46 wherein said processing means further includes means for causing said processing means to provide data to said display means to normally display the current time, said processing means providing data to said display means to display the current date in response to one of said function switches being actuated.

48. A system as defined in claim 47 wherein said processing means further includes means for causing said processing means to be selectively placed in one of said predetermined number of operating modes wherein said processing means receives and transmits selected data from and to said main computing means relating to the identification, status and operation of the apparatus.

49. A system as defined in claim 48 wherein said processing means further includes means for causing said processing means to be placed in said identification mode wherein said processing means receives data which specifies the identification of the apparatus, said processing means being placed in said identification mode in response to said mode switch being selectively operated, said identification being inputted by operation of one of said function switches and accepted by the other function switch.

50. A system as defined in claim 48 wherein said processing means further includes means for causing said processing means to be placed in said data transfer mode wherein said processing means transfers data from said memory means to the external computing means, said processing means being placed in said data transfer mode in response to said mode switch being selectively operated.

51. A system as defined in claim 48 wherein said processing means further includes means for causing said processing means to be placed in said alarm display mode wherein said processing means provides data to said display means to cause said display means to display the time of said next set alarm, said processing means being placed in said data transfer mode in response to said mode switch being selectively operated.

52. A system as defined in claim 45 wherein said processing means further includes means for causing said processing means to provide data to said display means to display an indication of said battery having a voltage level below said predetermined level in response to said processing means receiving said signal from said circuit means.

53. A system as defined in claim 43 wherein said circuit means includes means for measuring the voltage level of said battery and provides a signal indicating that the voltage level of said battery is below a predetermined level.

54. A system as defined in claim 32 wherein said restraint switching means comprises a mechanically actuated electrical switch that is mounted within said opening and is adapted to be operated by the insertion and removal of said elongated flexible restraint.

55. A system as defined in claim 32 wherein said processing means further includes means for recording data indicating the time and date of each operation of said restraint switching means in said memory means.

56. A system as defined in claim 32 wherein said processing means further includes means for encrypting said time and date indicating data according to a predetermined algorithm that so that such data cannot be easily manipulated without implementation of a security key.

* * * * *